US008052142B2

(12) United States Patent
Sugiyama et al.

(10) Patent No.: US 8,052,142 B2
(45) Date of Patent: Nov. 8, 2011

(54) PAPER TRANSPORT APPARATUS WITH INVERTING TURN GUIDE HAVING RANGE OF CURVATURE RADIUS

(75) Inventors: Yoshihide Sugiyama, Kinokawa (JP); Nobuki Tanimoto, Kinokawa (JP); Kazuya Yamamoto, Kinokawa (JP); Katsunori Takahashi, Kinokawa (JP)

(73) Assignees: Duplo Seiko Corporation, Wakayama (JP); Seiko Epson Corporation, Tokyo (JP)

( * ) Notice: Subject to any disclaimer, the term of this patent is extended or adjusted under 35 U.S.C. 154(b) by 432 days.

(21) Appl. No.: 12/221,716

(22) Filed: Aug. 6, 2008

(65) Prior Publication Data

US 2009/0066015 A1 Mar. 12, 2009

(30) Foreign Application Priority Data

Sep. 7, 2007 (JP) ..... 2007-232472

(51) Int. Cl.
*B65H 5/00* (2006.01)

(52) U.S. Cl. ..... 271/225

(58) Field of Classification Search ..... 271/225, 271/186

See application file for complete search history.

(56) References Cited

U.S. PATENT DOCUMENTS

| | | | | |
|---|---|---|---|---|
| 3,548,783 | A * | 12/1970 | Knapp | 399/374 |
| 4,905,984 | A * | 3/1990 | Haigh | 271/186 |
| 5,333,851 | A * | 8/1994 | Kulpa | 271/225 |
| 6,227,541 | B1 * | 5/2001 | Couillard et al. | 271/225 |
| 6,585,263 | B1 * | 7/2003 | Bredenberg et al. | 271/182 |
| 7,918,449 | B2 * | 4/2011 | Sugiyama et al. | 271/186 |
| 2002/0141805 | A1 * | 10/2002 | Bobrow et al. | 400/188 |
| 2007/0013122 | A1 * | 1/2007 | Kawai | 271/90 |

FOREIGN PATENT DOCUMENTS

JP 2008074532 A * 4/2008

OTHER PUBLICATIONS

International Paper, International Paper Knowledge Center, printed Oct. 25, 2010, "Internation Paper—Characteristics", pp. 1-4, http://glossary.ippaper.com/default.asp?req=knowledge/article/230.*

* cited by examiner

*Primary Examiner* — Stefanos Karmis
*Assistant Examiner* — Gerald McClain
(74) *Attorney, Agent, or Firm* — Fildes & Outland, P.C.

(57) ABSTRACT

A turn guide is disposed between a first transport surface and a second transport surface on which a sheet is transported while being sucked. The turn guide has a plurality of guide ribs. The plurality of guide ribs have curved inverting transfer surfaces from an inversion start point corresponding to a first transport surface to an inversion end point corresponding to a second transport surface.

1 Claim, 31 Drawing Sheets

PAPER TRANSPORT APPARATUS WITH INVERTING TURN GUIDE HAVING RANGE OF CURVATURE RADIUS

FIELD OF THE INVENTION

The present invention relates to a paper transport apparatus and a technique of inverting a sheet of paper when changing a transport direction of the sheet on a transport path of the sheet in a printer and so on.

BACKGROUND OF THE INVENTION

Conventionally, this kind of apparatus includes a paper feeder as disclosed in, for example, Japanese Patent Laid-Open No. 10-95550. The paper feeder includes a paper feed tray for loading sheets of paper, a feeding part for feeding, one by one, the sheets of paper loaded on the paper feed tray, a turn guide for changing the transport direction of the sheet of paper fed from the paper feed tray by the feeding part, and a plurality of ribs formed on the turn guide so as to have long shapes along the transport direction of the sheets of paper. The sheets of paper loaded on the paper feed tray are fed one by one and the ribs on the turn guide change the transport directions of the sheets of paper.

Further, Japanese Patent Laid-Open No. 2000-95382 discloses an apparatus including a feed/transport guide for guiding a recording medium so as to bend the recording medium, a first transport roller disposed near the bending start position of the feed/transport guide, and a second transport roller disposed near an inversion start position where the recording medium having passed through the first transport roller starts to be inverted while being bent. A sheet of paper transported by the first transport roller and the second transport roller is inverted along the feed/transport guide.

Moreover, Japanese Patent Laid-Open No. 2001-233497 discloses an apparatus including a transport roller for transporting a recorded material to a recording part, a transport driven roller which is rotated in a driven manner while being pressed to the transport roller, a feed roller for feeding the recorded material to the transport roller and the transport driven roller, a supply path for supplying the recorded material while bending and inverting the recorded material along the outer surface of the feed roller, and a guide member which is separated from the outer surface of the feed roller and comes into contact with the recorded material to guide the recorded material. On the guide surface of the guide member, a plurality of guide rollers are provided which are rotated in a driven manner in response to the supply of the recorded material.

Further, Japanese Patent Laid-Open No. 2002-302316 discloses an apparatus including a holding roller for holding and transporting roll paper and a guide member disposed near the downstream side of the holding roller. The guide member has a guide surface formed to be bent opposite to the curling of the roll paper, and the curling of the roll paper is corrected by bringing the guide surface into contact with the unprinted side of the roll paper.

Moreover, Japanese Patent Laid-Open No. 2006-27799 discloses an apparatus including a transport path for transporting a recording medium to an image forming position by using a transport roller and an ejection path for ejecting the recording medium after an image is formed. The amount of transport of the recording medium is controlled by monitoring the amount of drive of the transport roller, and the amount of drive of the transport roller is corrected based on the winding angle of the recording medium relative to the transport roller and the thickness of the recording medium.

Further, Japanese Patent Laid-Open No. 2007-145539 discloses an apparatus including a recorder for recording an image on a recording medium, a storage for storing recording media of multiple sizes, a separator for separately feeding the stored recording media, and an inversion device for inverting the fed recording media. Rollers in multiple rows are disposed on the guide of the inverting device and a slider is disposed on the guide. The slider is set lower than the rollers and a recording medium such as cardboard having high stiffness is fed while inverted.

In the configurations of the prior art, a sheet of paper is sandwiched between rollers when transported or inverted and thus the rollers are in direct contact with the printed surface of the sheet. Thus when a paper transport apparatus configured according to the prior art is applied to a stencil duplicator and an inkjet printer, a printed surface is smudged.

Further, in a configuration for sucking a sheet of paper on a transport belt, the transport belt itself cannot form a curved inversion path. Thus a pair of transport apparatuses including transport belts forming linear transport paths are sequentially disposed on the front end and the rear end of a paper transport direction, and a turn guide having a curved surface for inverting a sheet of paper is disposed between the transport apparatuses. When a sheet of paper is inverted, the sheet is bent along the curved surface of the turn guide.

However, it is difficult to provide the turn guide with a sucking function and thus a suction force is not applied to a sheet of paper at the turn guide while the sheet is moved from one transport apparatus to another. Thus when a transport force is applied to the sheet at the front and rear of the turn guide, particularly cardboard having high stiffness has a large transport resistance at the turn guide, increasing the possibility that an insufficient transport force may cause faulty transport. Further, when the sheet is forcibly transported, the sheet may be curled or may be sharply bent in the worst case.

The present invention is devised to solve the foregoing problems. An object of the present invention is to provide a paper transport apparatus which can smoothly invert a sheet of paper by adjusting the curvature radius of the curved surface of a turn guide in the transport path of the sheet of paper.

DISCLOSURE OF THE INVENTION

In order to solve the problems, a paper transport apparatus of the present invention includes: a first transport apparatus forming a first transport surface; a second transport apparatus forming a second transport surface; and a turn guide provided between the first transport apparatus and the second transport apparatus to invert a sheet of paper when the sheet is transferred from the first transport surface to the second transport surface, wherein the turn guide has slidable contact portions coming into slidable contact with the sheet and forming inverting transfer surfaces, the inverting transfer surfaces are curved around the inversion axis of the sheet from an inversion start point corresponding to the first transport surface to an inversion end point corresponding to the second transport surface, and the inverting transfer surfaces have a curvature radius at least 100 times as large as the thickness of the sheet and less than 0.29 times as large as the length of the sheet in a transport direction.

A paper transport apparatus of the present invention includes: a first transport apparatus forming a first transport surface; a second transport apparatus forming a second transport surface; and a turn guide provided between the first transport apparatus and the second transport apparatus to invert a sheet of paper when the sheet is transferred from the first transport surface to the second transport surface, wherein the first transport, apparatus and the second transport apparatus each include a plurality of transport belts moving on a transport path along a paper transport direction and a suction device for sucking the sheet on the transport belts through suction holes formed on the transport belts, the turn guide has a plurality of guide ribs, the plurality of guide ribs are arranged along the inversion axis of the sheet, are disposed between the transport belts, and have slidable contact portions coming into slidable contact with the sheet and forming inverting transfer surfaces, the inverting transfer surfaces are curved around the inversion axis of the sheet from an inversion start point corresponding to the first transport surface to an inversion end point corresponding to the second transport surface, the turn guide has the multiple kinds of guide ribs arranged in an alternating manner and including the inverting transfer surfaces having different curvature radii, the guide ribs having the same curvature radius are connected as a guide rib group, the guide rib group can move between an operation position where the guide rib group is connected to the first transport surface and the second transport surface so as to guide the sheet and a retraction position where the guide rib group is separated from the first transport surface and the second transport surface so as not to guide the sheet.

Furthermore, in the paper transport apparatus according to the present invention, on the guide ribs, the inverting transfer surfaces have a curvature radius at least 100 times as large as the thickness of the sheet and less than 0.29 times as large as the length of the sheet in the transport direction, and the curvature radius of the inverting transfer surfaces of the guide ribs in one of the guide rib groups and the curvature radius of the inverting transfer surfaces of the guide ribs in the other guide rib group vary with one of the size and thickness of the sheet.

As described above, according to the present invention, a sheet is inverted around the inversion axis at the turn guide while being transported from the first transport surface of the first transport apparatus to the second transport surface of the second transport apparatus through the inverting transfer surfaces of the turn guide. At this point, the printed surface of the sheet does not come into contact with the constituent members of an inversion device. Thus it is possible to eliminate an ink stain and prevent smudges on a surface of the sheet.

As the inverting transfer surfaces of the guide ribs have a larger curvature radius, a thick sheet can be easily inverted and it becomes difficult to invert a sheet having a short length in the transport direction, whereas as the inverting transfer surfaces have a smaller curvature radius, it becomes difficult to invert a thick sheet and a sheet having a short length in the transport direction can be easily inverted.

Therefore, the guide rib groups can move between the operation position where the guide rib groups are connected to the first transport surface and the second transport surface so as to guide the sheet and the retraction position where the guide rib groups are separated from the first transport surface and the second transport surface so as not to guide the sheet, and the guide rib group having the optimum curvature radius for the size and thickness of the sheet to be transported is disposed on the operation position, so that the sheet can be smoothly inverted.

It is preferable that in each of the guide rib groups, the inverting transfer surfaces of the guide ribs have a curvature radius at least 100 times as large as the thickness of the sheet and less than 0.29 times as large as the length of the sheet in the transport direction.

DESCRIPTION OF THE EMBODIMENTS

Embodiments of the present invention will now be described in accordance with the accompanying drawings. First, referring to FIGS. 24 to 28, the following will discuss an application of a paper transport apparatus and a paper transport path according to the present invention.

Figure 24:
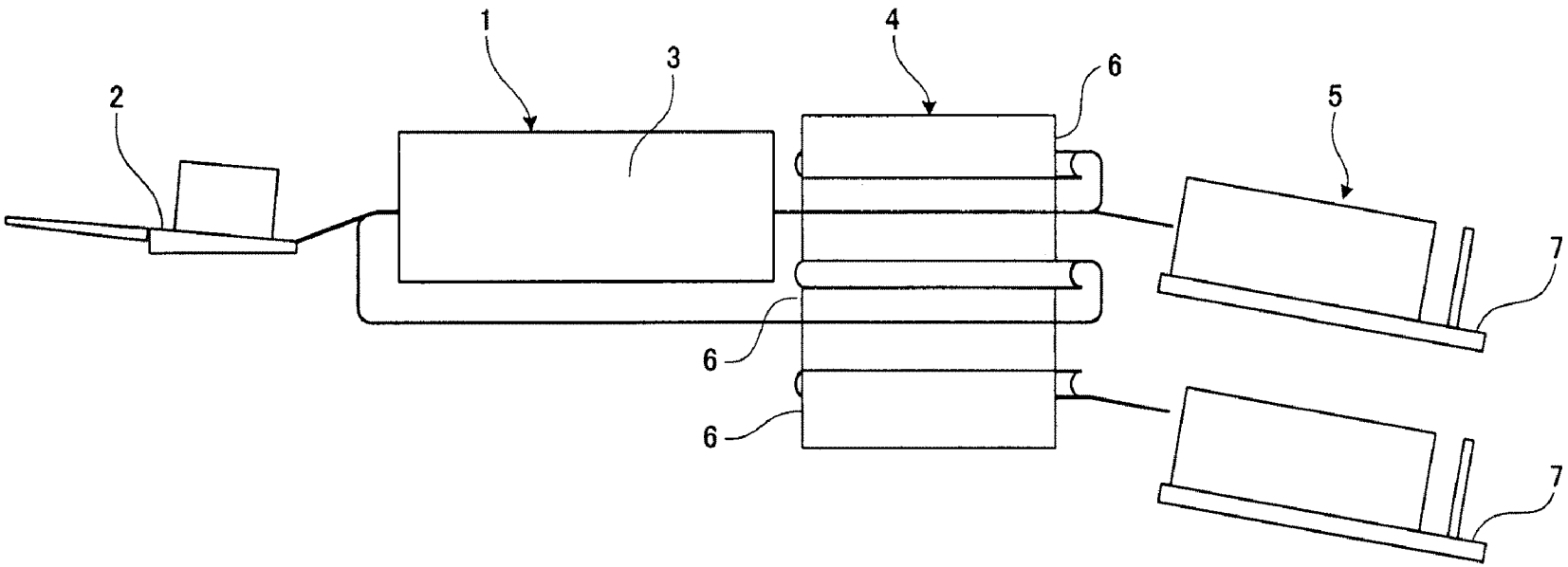
FIG. 24 is a schematic view showing a transport path of a sheet of paper according to the embodiment of the present invention.
Figure 25:
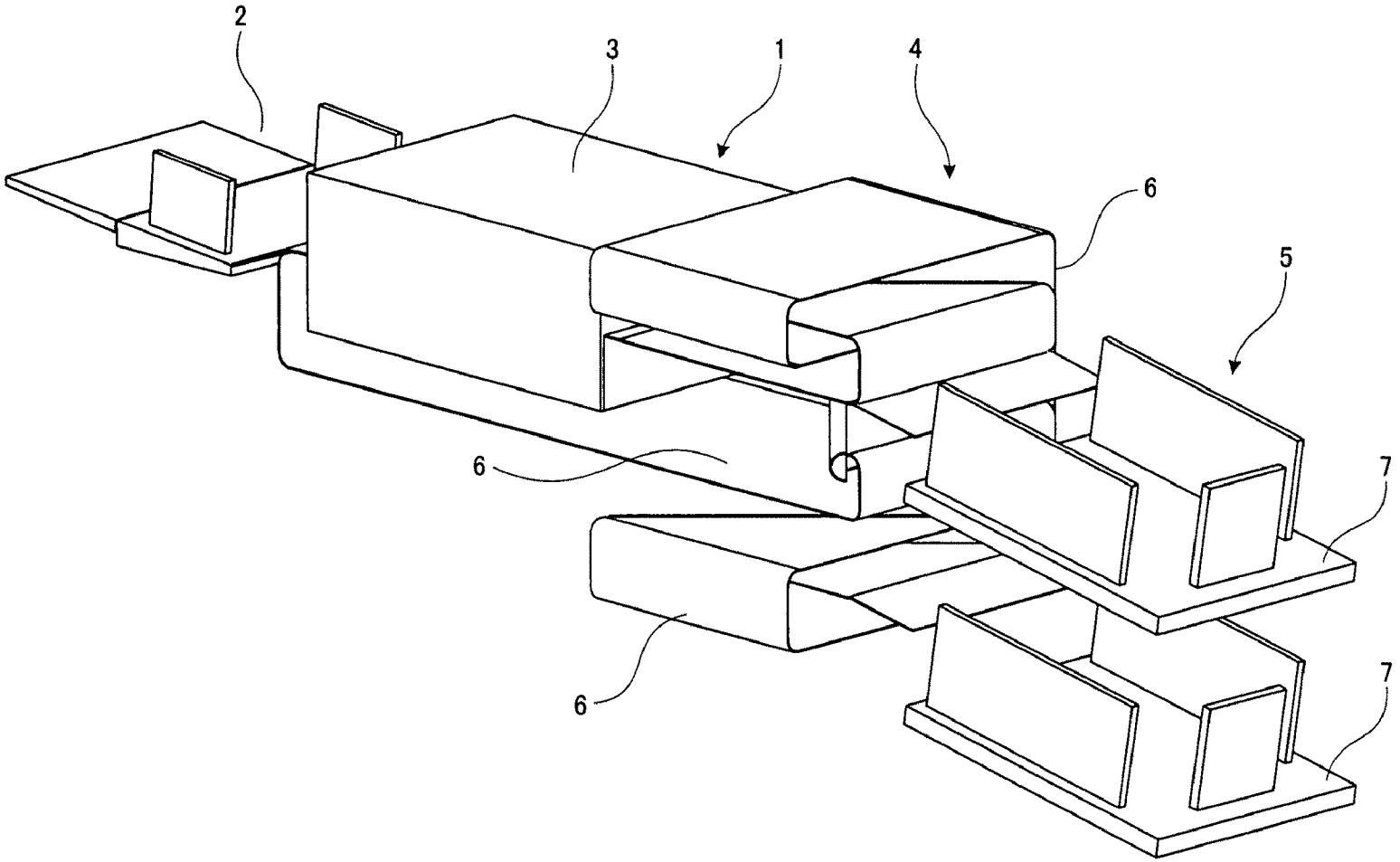
FIG. 25 is a schematic view showing the transport path of a sheet of paper according to the embodiment of the present invention.

As shown in FIGS. 24 and 25, an inkjet printer will be illustrated as an application of the paper transport apparatus of the present invention. The present invention is also applicable to a stencil duplicator, a screen printer, and so on.

(Overall Configuration)

An inkjet printer 1 is made up of a paper feed mechanism 2, a printer body 3, a paper inverting mechanism 4, and a paper receiving mechanism 5. In this configuration, the printer body 3 performs printing by jetting water-based ink onto a surface of a sheet of paper according to an inkjet printing system. The paper inverting mechanism 4 is a combination of a plurality of inverting transfer units 6 which are respectively disposed on a top stage, a middle stage, and a bottom stage, so that a plurality of transport paths can be selectively formed. The paper receiving mechanism 5 is made up of a plurality of paper receiving units 7. Sheets of paper ejected from the paper inverting mechanism 4 are received by the paper receiving units 7 which selectively correspond to the plurality of transport paths formed in the paper inverting mechanism 4.

(Single-Sided Printing)

Figure 26:
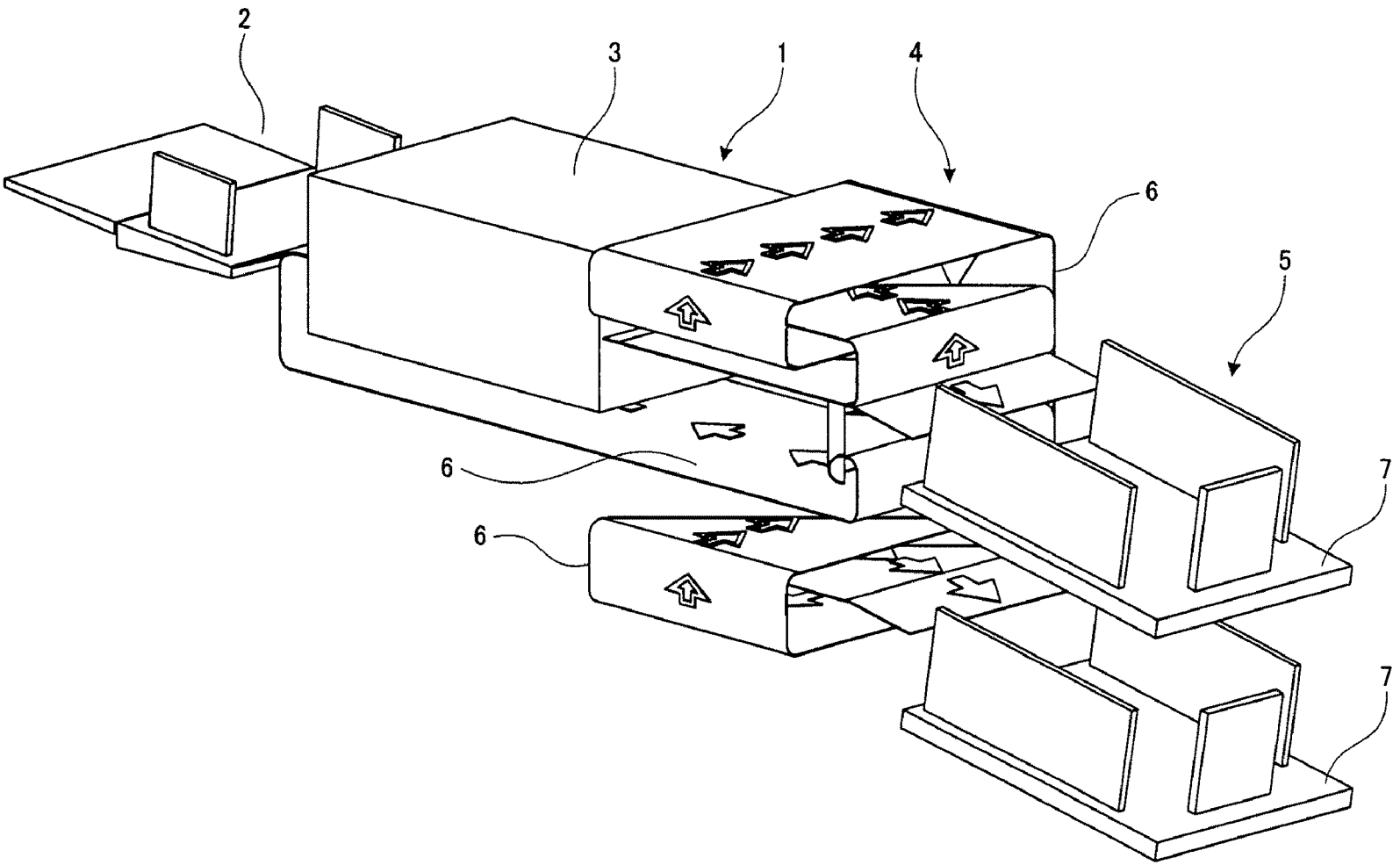
FIG. 26 is a schematic view showing the transport path of a sheet of paper according to the embodiment of the present invention.
Figure 27:
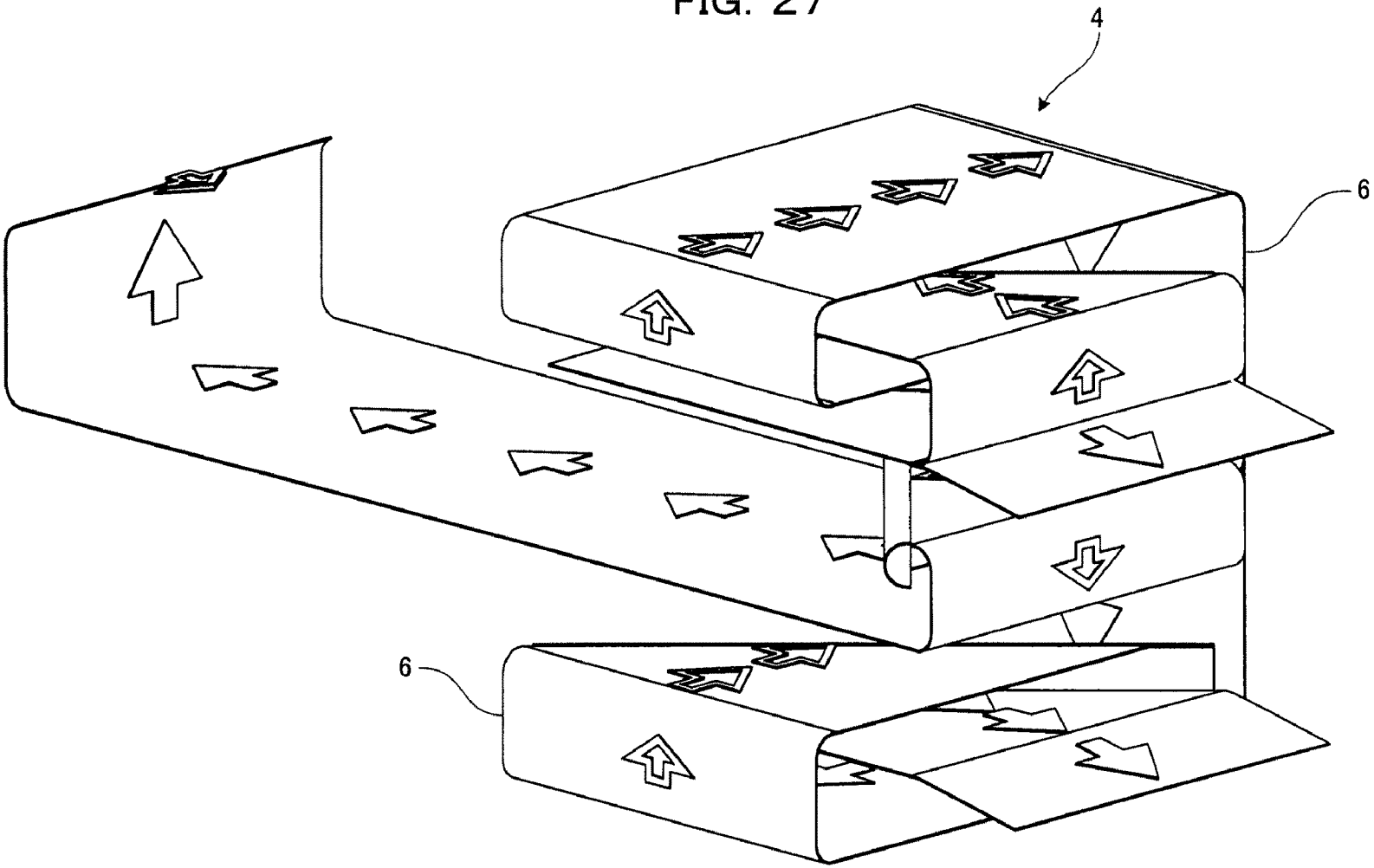
FIG. 27 is a schematic view showing the transport path of a sheet of paper according to the embodiment of the present invention.
Figure 28:
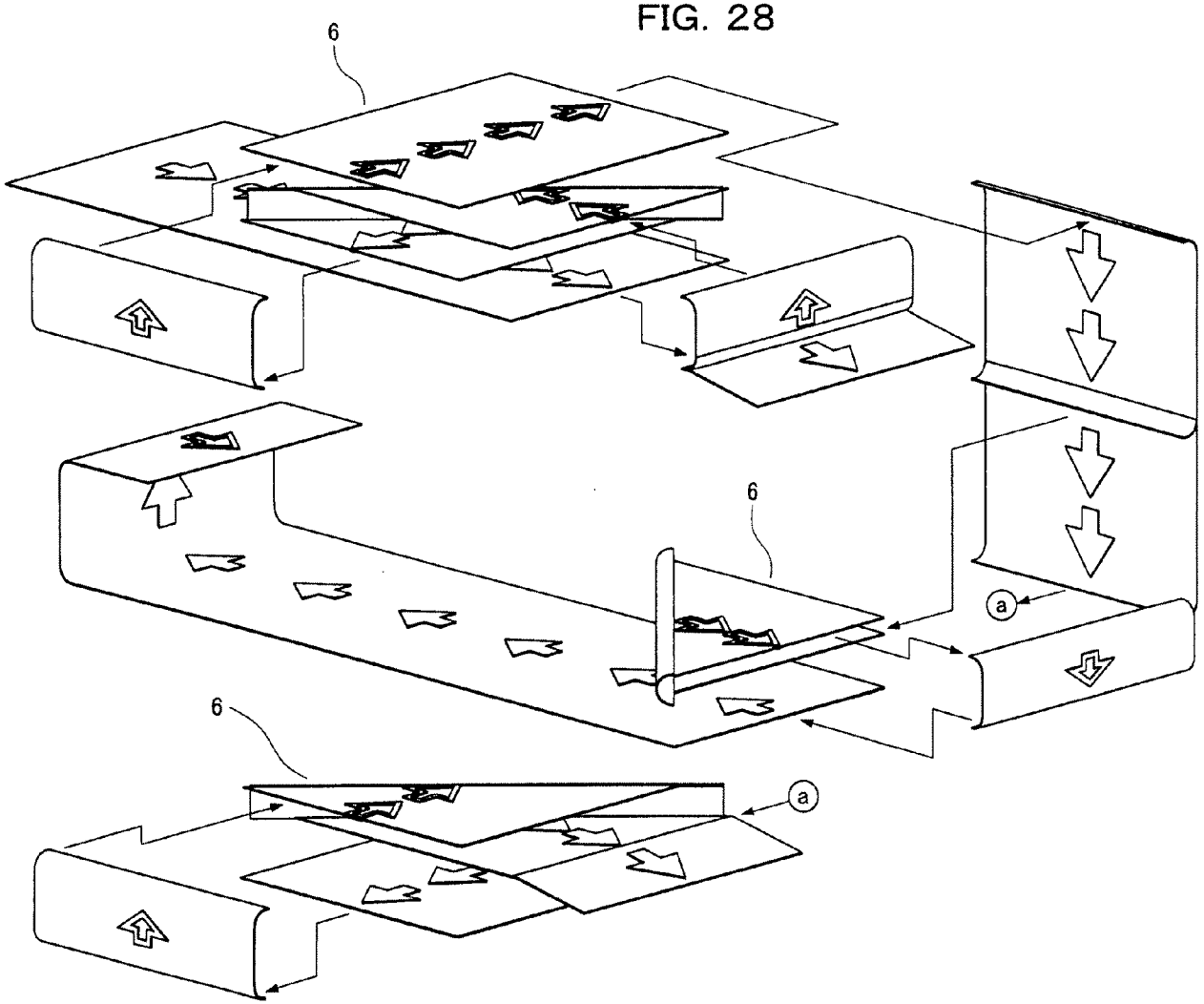
FIG. 28 is a schematic view showing the transport path of a sheet of paper according to the embodiment of the present invention.

As shown in FIGS. 26 to 28, the paper feed mechanism 2 feeds sheets of paper one by one to the printer body 3. One side of the sheet is printed in the printer body 3 and the printed sheet is ejected to the paper receiving unit 7 through the paper inverting mechanism 4. When the sheet is ejected to the paper receiving unit 7 in the shortest time after the sheet is printed in the printer body 3, the sheet is passed through the inverting transfer unit 6 on the top stage of the paper inverting mechanism 4 without being inverted, and then the sheet is ejected to the paper receiving unit 7.

After printed in the printer body 3, when the sheet of paper has to be kept in the paper inverting mechanism 4 for a longer time to dry the printed surface of the sheet, the sheet is inverted by the inverting transfer unit 6 on the top stage of the paper inverting mechanism 4, is transferred to the inverting transfer unit 6 on the bottom stage, is inverted by the inverting transfer unit 6 on the bottom stage, and then is ejected to the lower paper receiving unit 7.

(Double-Sided Printing)

The paper feed mechanism 2 feeds sheets of paper one by one to the printer body 3. One side of the sheet is printed in the printer body 3. After printed in the printer body 3, the sheet is inverted by the inverting transfer unit 6 on the top stage of the paper inverting mechanism 4, is inverted by the inverting transfer unit 6 on the middle stage, and then is returned to a feed port of the printer body 3. After that, the other side of the sheet is printed in the printer body 3. After printed in the printer body 3, the sheet is inverted by the inverting transfer unit 6 on the top stage of the paper inverting mechanism 4, is transferred to the inverting transfer unit 6 on the bottom stage, is inverted by the inverting transfer unit 6 on the bottom stage, and then is ejected to the lower paper receiving unit 7.

Figure 29:
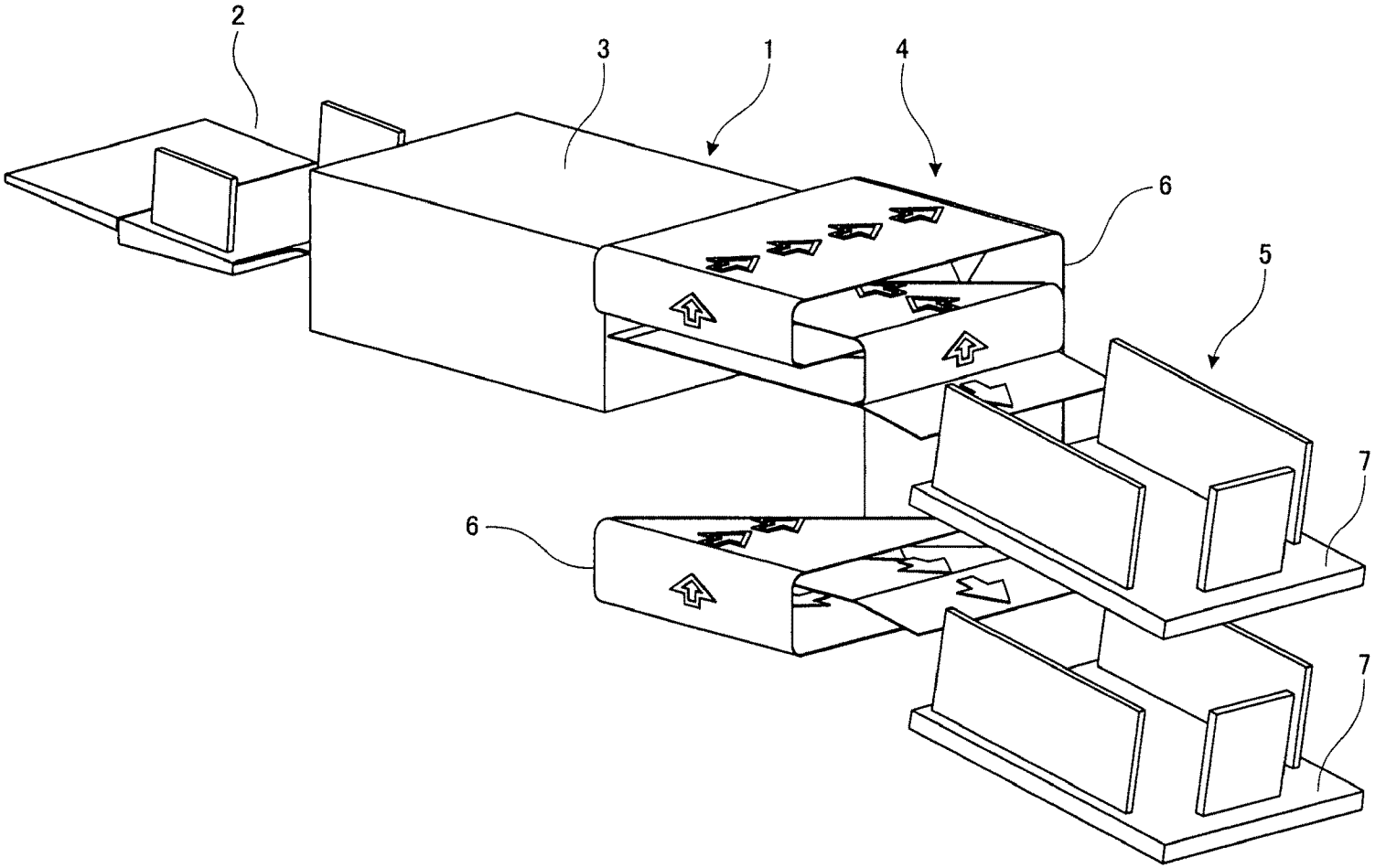
FIG. 29 is a schematic view showing the transport path of a sheet of paper according to the embodiment of the present invention.
Figure 30:
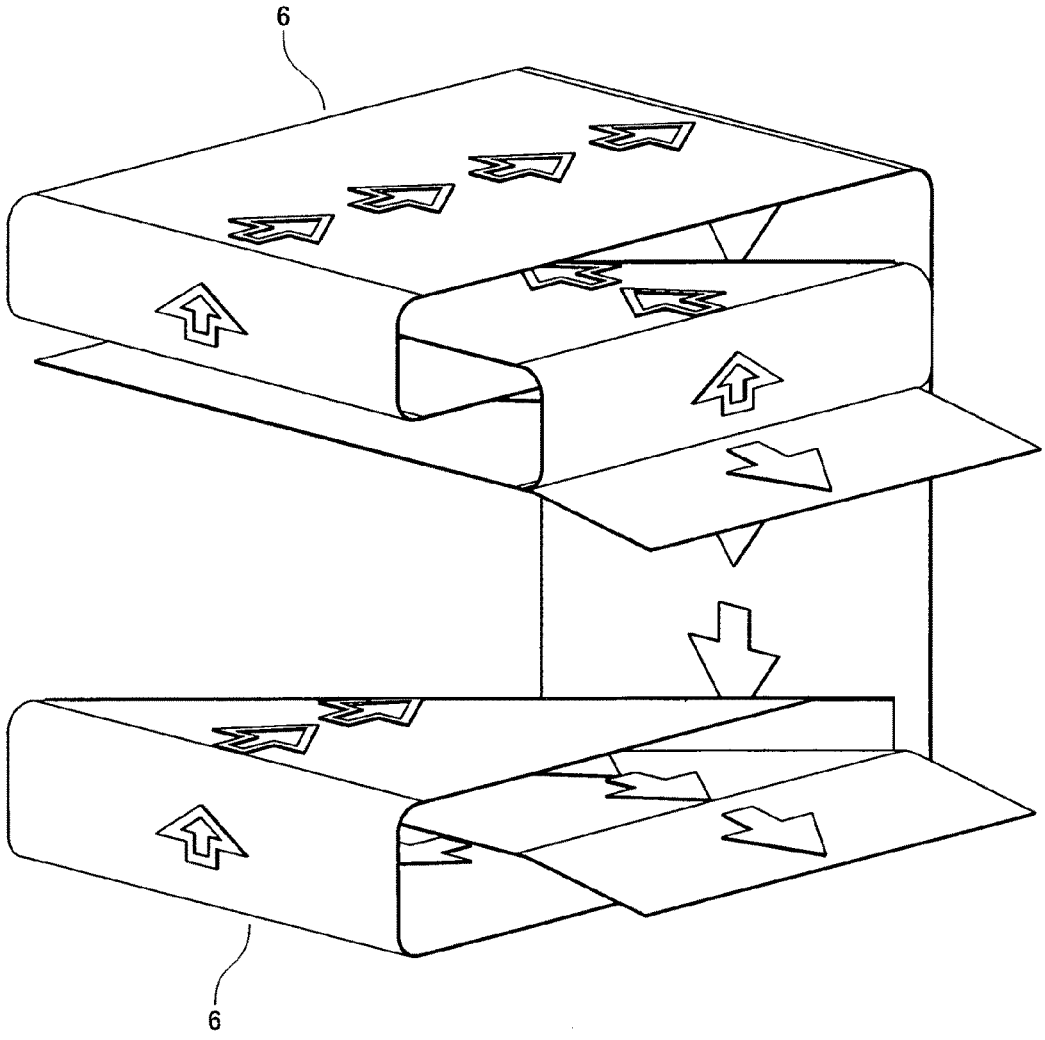
FIG. 30 is a schematic view showing the transport path of a sheet of paper according to the embodiment of the present invention.
Figure 31:
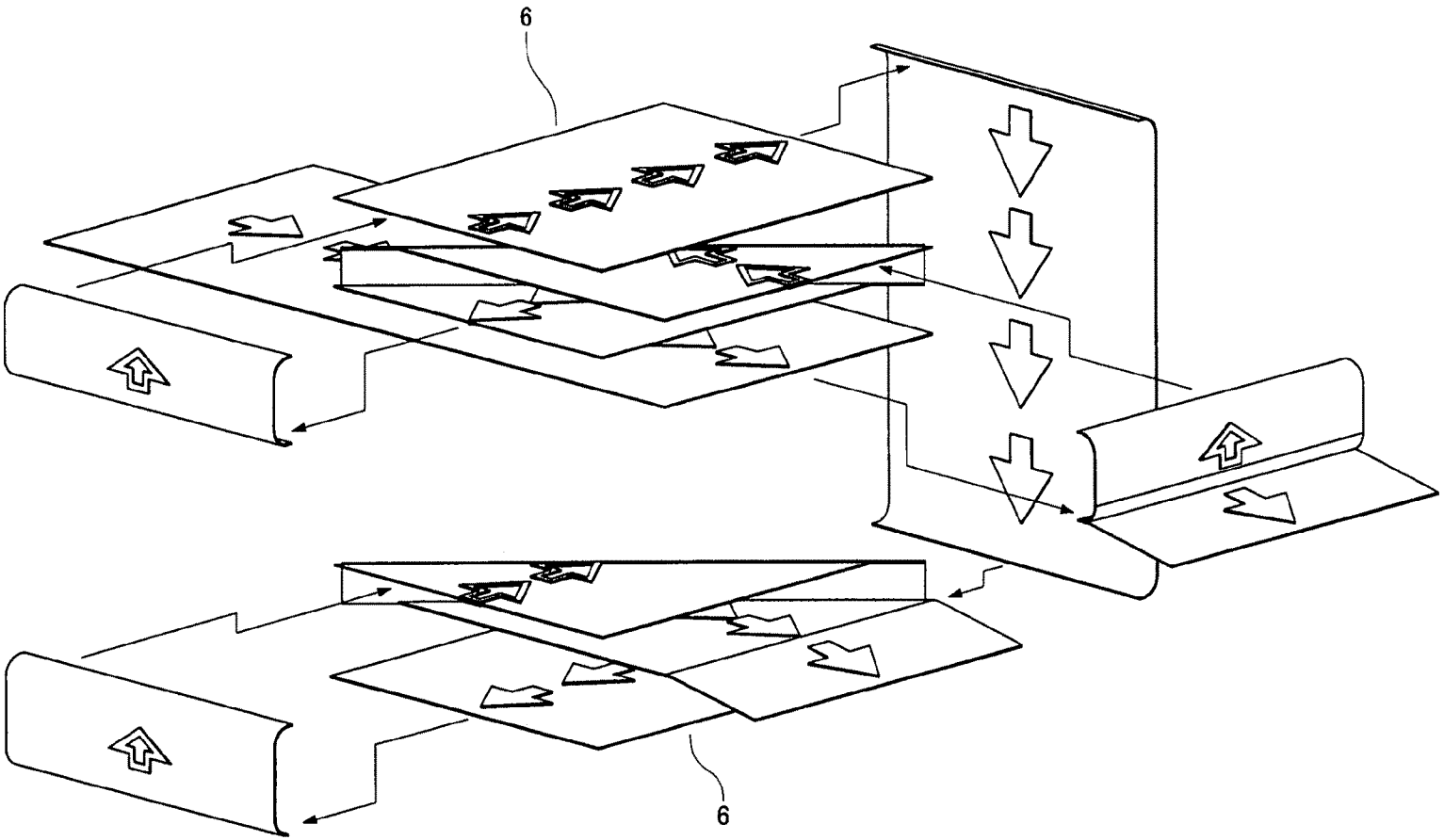
FIG. 31 is a schematic view showing the transport path of a sheet of paper according to the embodiment of the present invention.

Referring to FIGS. 29 to 31, another application of the paper transport apparatus of the present invention will be described below.

(Overall Configuration)

The same constituent elements as the constituent elements of the foregoing configuration are indicated by the same reference numerals in the following explanation. In this configuration, a paper inverting mechanism is a combination of upper and lower inverting transfer units 6 which can selectively form a plurality of transport paths.

(Single-Sided Printing)

As shown in FIGS. 29 to 31, a paper feed mechanism 2 feeds sheets of paper one by one to a printer body 3. One side of the sheet is printed in the printer body 3 and the printed sheet is ejected to a paper receiving unit 7 through a paper inverting mechanism 4. When the sheet is ejected to the paper receiving unit 7 in the shortest time after the sheet is printed in the printer body 3, the sheet is passed through the upper inverting transfer unit 6 of the paper inverting mechanism 4 without being inverted, and then the sheet is ejected to the paper receiving unit 7.

After printed in the printer body 3, when the sheet of paper has to be kept in the paper inverting mechanism 4 for a longer time to dry the printed surface of the sheet, the sheet is inverted by the upper inverting transfer unit 6 of the paper inverting mechanism 4, is transferred to the lower inverting transfer unit 6, is inverted by the lower inverting transfer unit 6, and then is ejected to the lower paper receiving unit 7.

Figure 1:
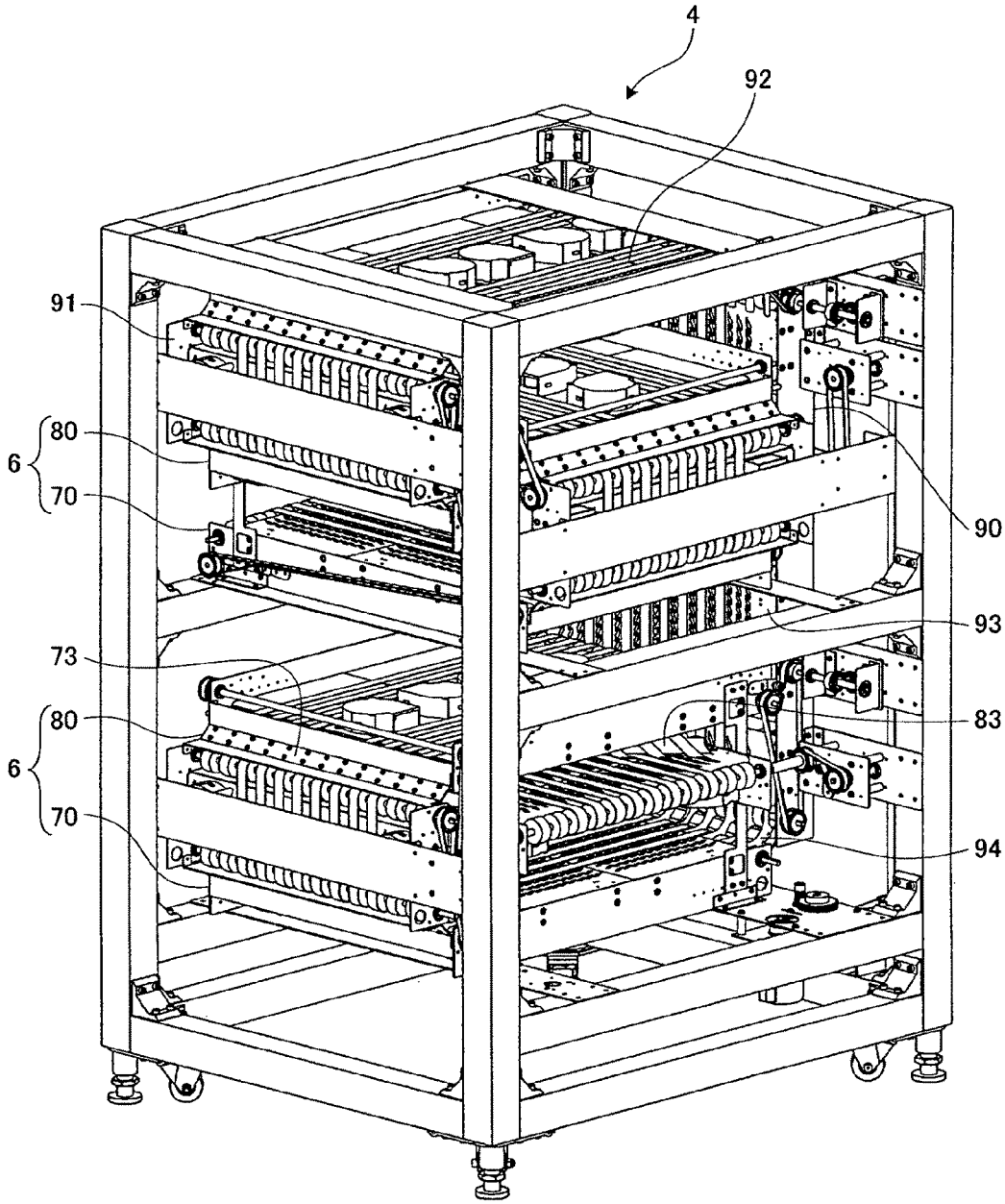
FIG. 1 is a perspective view showing a paper transport apparatus according to an embodiment of the present invention.

Referring to FIGS. 1 to 7, the paper inverting mechanism 4 of the present invention will be specifically described below. In FIG. 1, the paper inverting mechanism 4 includes the plurality of inverting transfer units 6 which are vertically stacked. Each of the inverting transfer units 6 includes a first paper transport apparatus 70 and a second paper transport apparatus 80 and further includes a third paper transport apparatus 90 between the upper and lower inverting transfer units 6. The paper inverting mechanism 4 shown in FIGS. 1 to 7 does not have a mechanism of returning sheets of paper to the printer body 3 but such a mechanism can be easily realized according to the following explanation.

Figure 2:
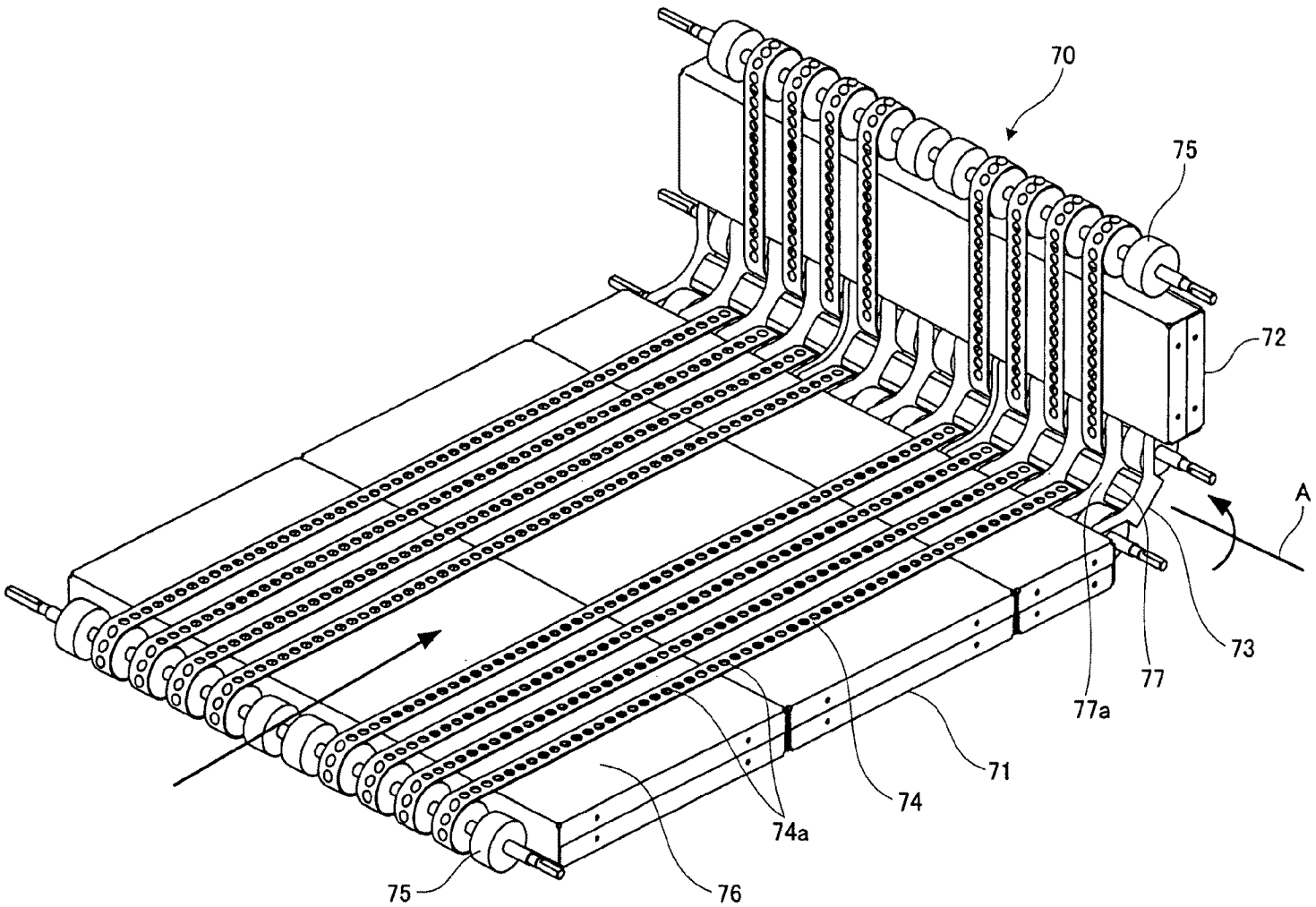
FIG. 2 is a perspective view showing a first paper transport apparatus according to the embodiment.

As shown in FIG. 2, the first paper transport apparatus 70 includes a first transport apparatus 71 forming a first transport surface on which a sheet of paper is transported in a horizontal direction, a second transport apparatus 72 forming a second transport surface on which a sheet of paper is transported in a direction orthogonal to the first transport surface, and a turn guide 73. When a sheet of paper is transported from the first transport surface to the second transport surface, the turn guide 73 rotates the sheet about an inversion axis A at a predetermined inversion angle, in this case, at 90°.

The first transport apparatus 71 and the second transport apparatus 72 include a plurality of transport belts 74 moving on a transport path along a paper transport direction. The transport belts 74 are each made up of an endless belt looped over belt rollers 75 disposed on both ends of the transport path.

Figure 19:
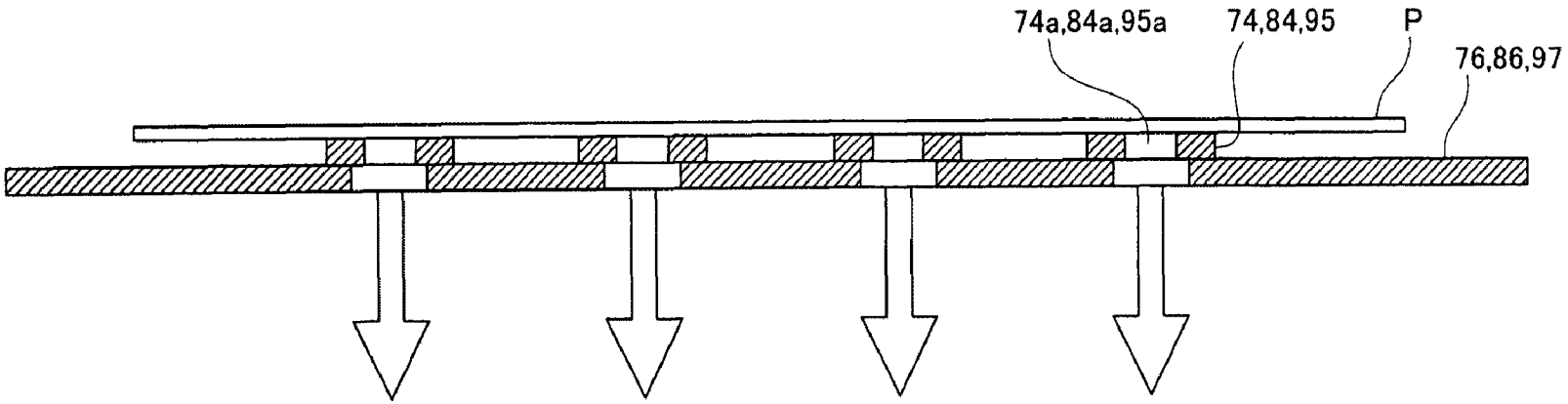
FIG. 19 is a sectional view showing a transport state of each transport apparatus according to the embodiment of the present invention.
Figure 23:
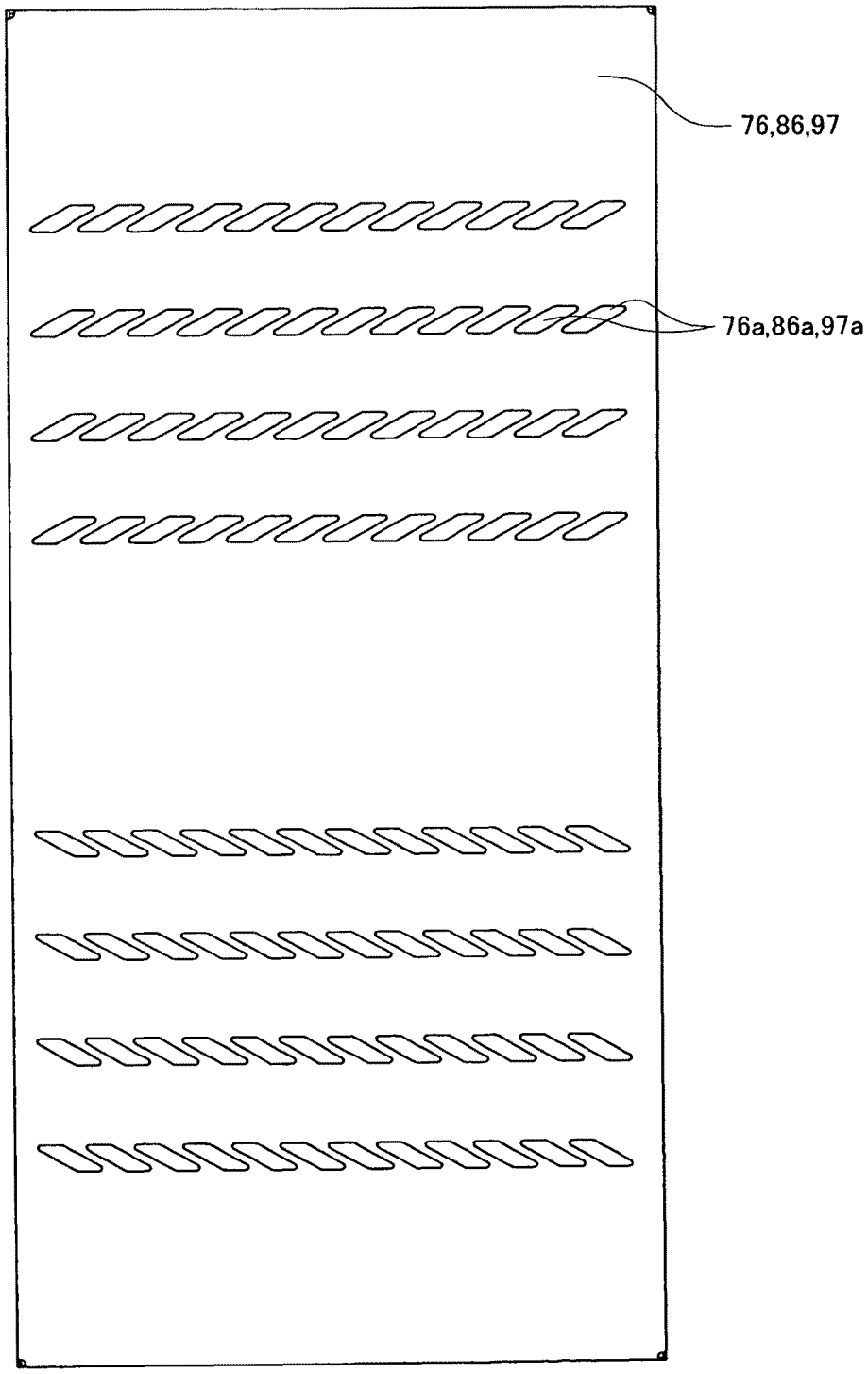
FIG. 23 is a schematic view showing the detail of each transport apparatus according to the embodiment of the present invention.

The transport path is formed on a suction box 76 acting as a suction device. The suction box 76 communicates with an air suction source (not shown). As shown in FIG. 23, the suction box 76 has a plurality of openings 76*a* under the transport path. As shown in FIG. 19, a sheet P is sucked on the transport belts 74 through suction holes 74*a* formed on the transport belts 74.

Figure 6:
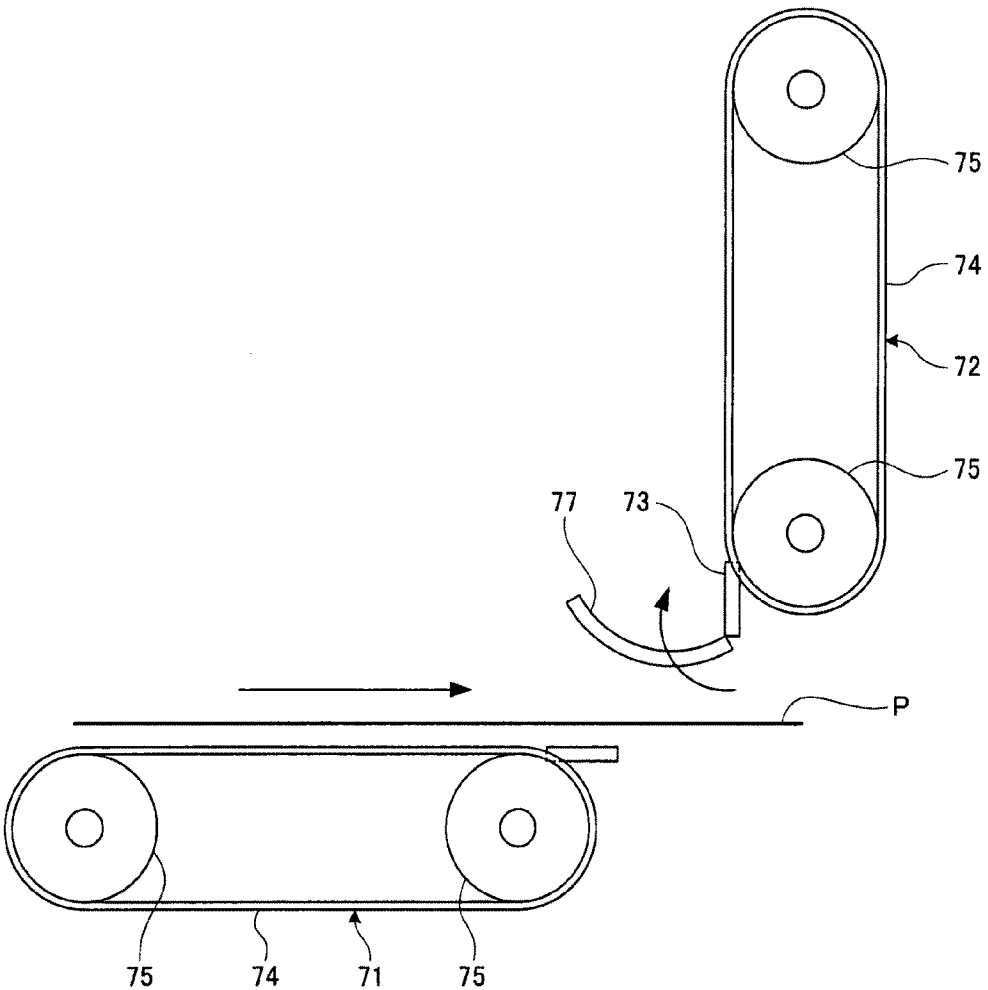
FIG. 6 is a side view showing an ejection mode of a turn guide of the first paper transport apparatus according to the embodiment.
Figure 7:
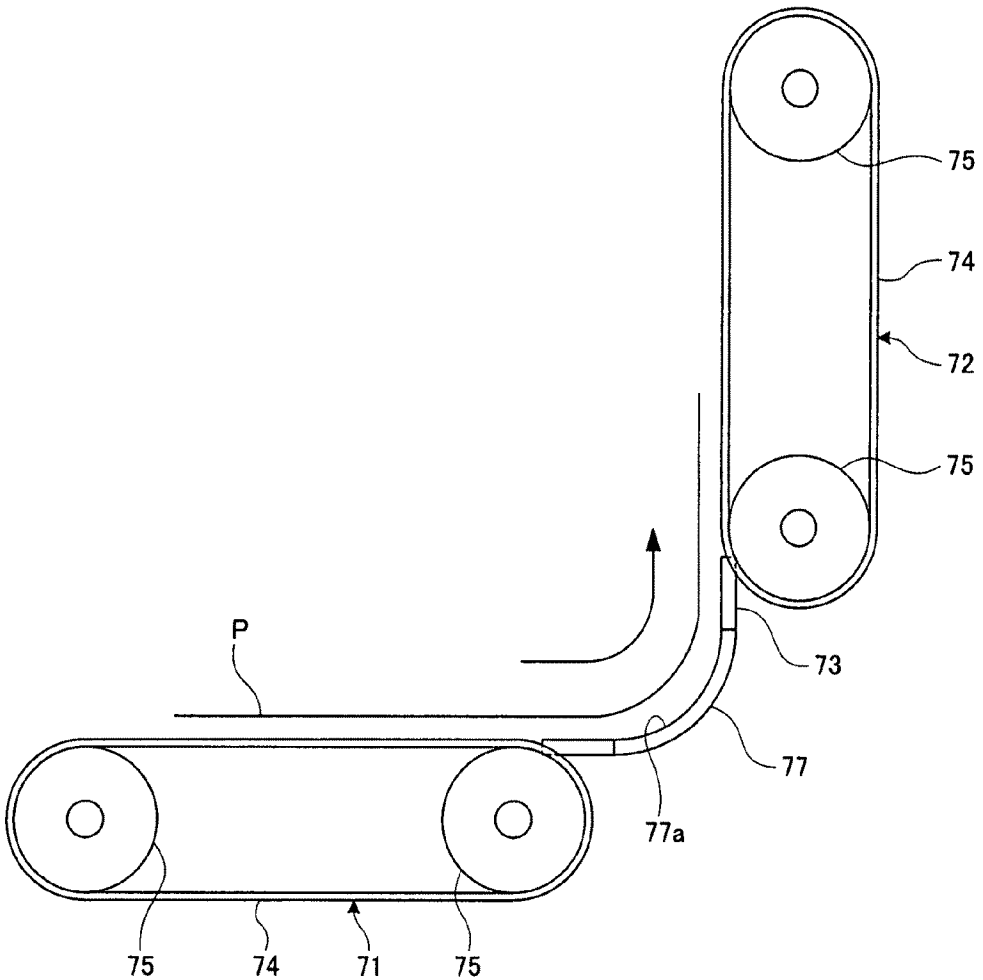
FIG. 7 is a side view showing an inversion mode of the turn guide of the first paper transport apparatus according to the embodiment.

The turn guide 73 has a plurality of guide ribs 77 which are arranged along the inversion axis with a 20 mm to 50 mm pitch and are interposed between the transport belts 74. The guide ribs 77 which are in slidable contact with the sheet P have slidable contact portions forming curved inverting transfer (i.e., inversion/transfer) surfaces 77*a* around the inversion axis A from an inversion start point corresponding to the first transport surface to an inversion end point corresponding to the second transport surface. As shown in FIGS. 6 and 7, the guide ribs 77 can swing between a state in which the first transport surface and the second transport surface are connected and a state in which the first transport surface and the second transport surface are separated from each other.

As the inversion/transfer surfaces 77*a* of the guide ribs 77 have a larger curvature radius, a thick sheet can be easily inverted and it becomes difficult to invert a sheet having a short length in the transport direction, whereas as the inversion/transfer surfaces 77*a* have a smaller curvature radius, it becomes difficult to invert a thick sheet and a sheet having a short length in the transport direction can be easily inverted.

Figure 8:
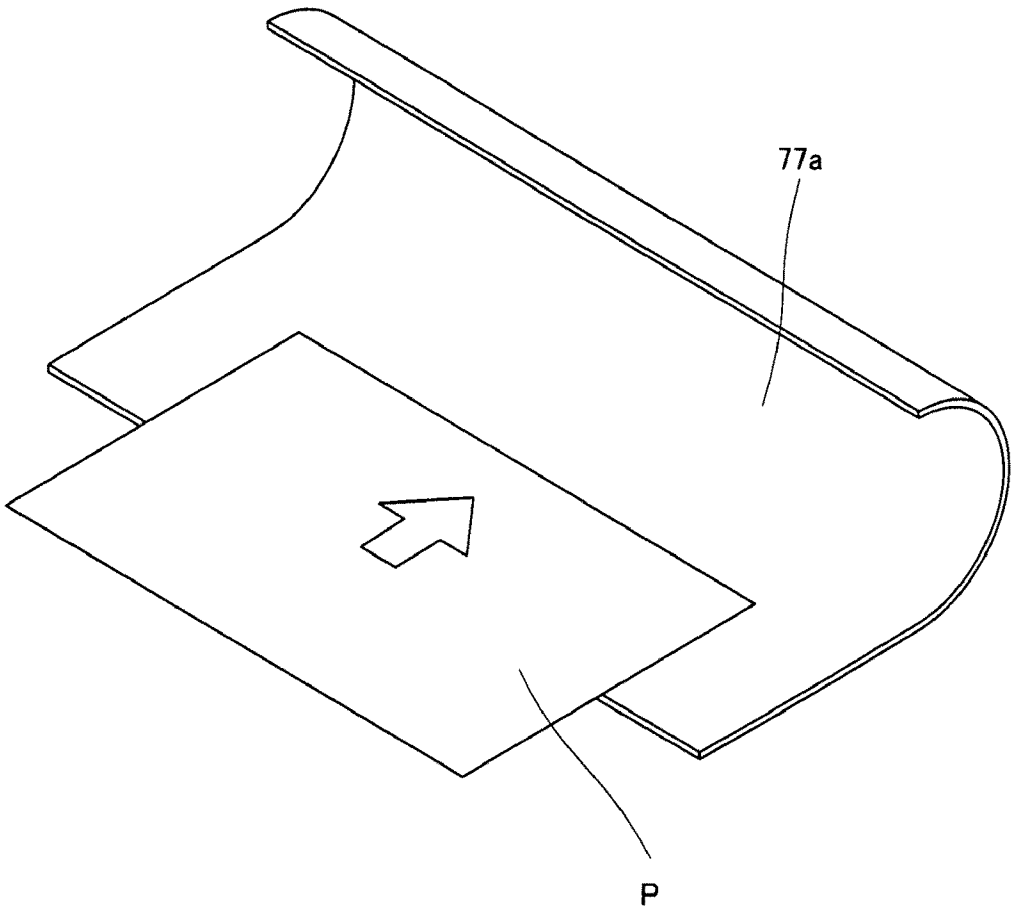
FIG. 8 is a schematic view showing a model for determining a curvature radius of an inverting transfer surface according to the embodiment of the present invention.
Figure 9:
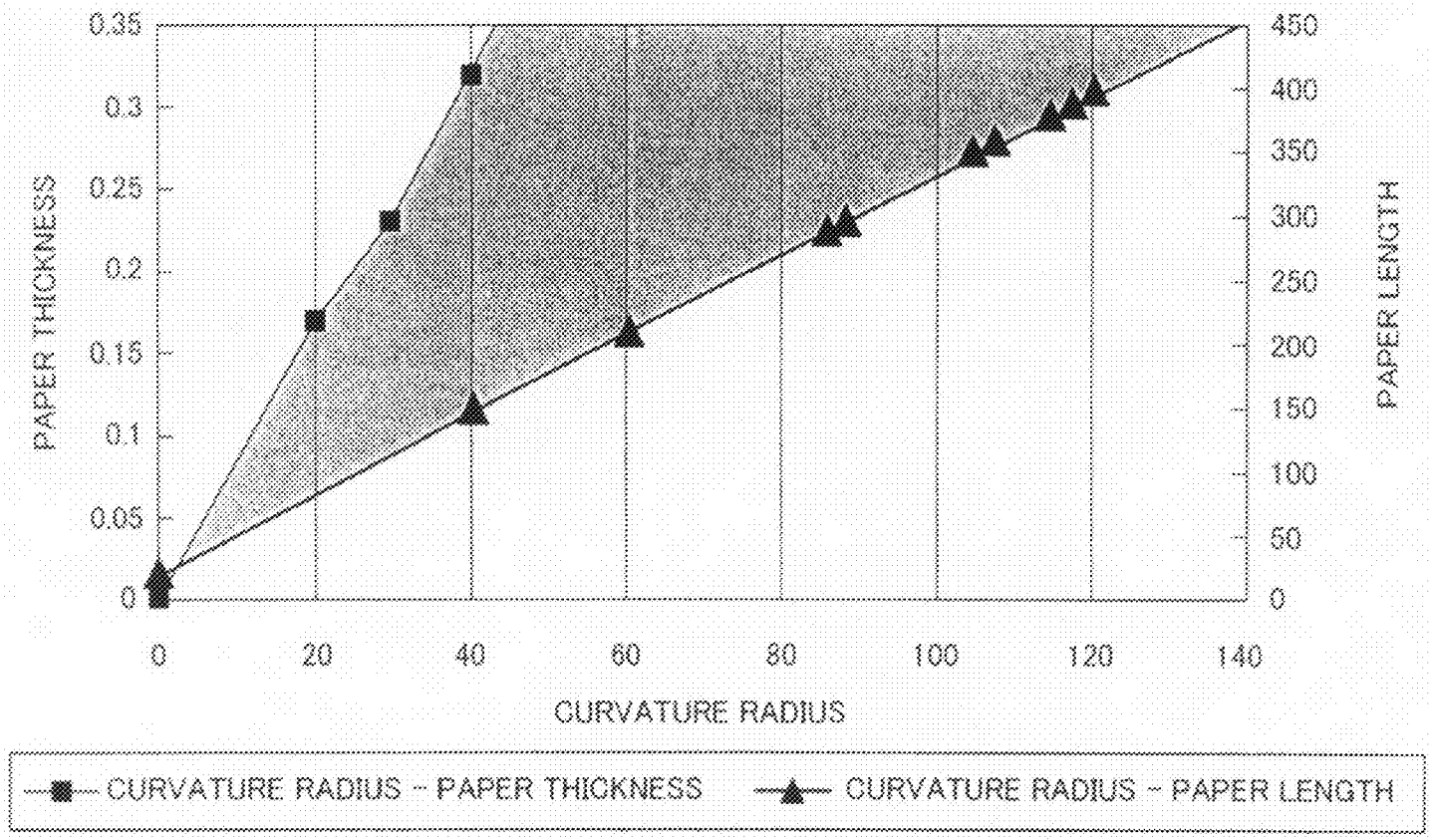
FIG. 9 is a graph showing a correlation between a curvature radius and a thickness of a sheet of paper and a correlation between a curvature radius and a length of the sheet of paper according to the embodiment.
Figure 10:
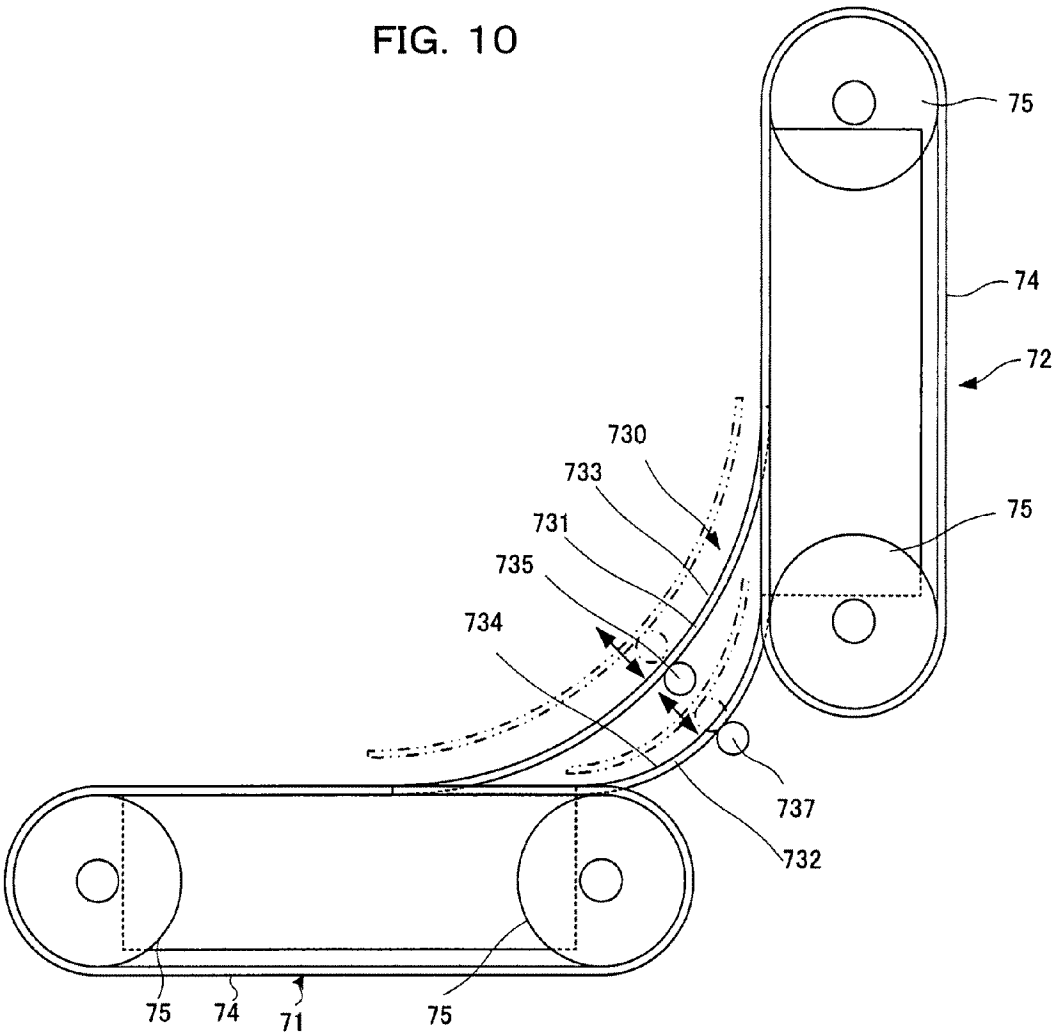
FIG. 10 is a side view showing a turn guide according to another embodiment of the present invention.
Figures 11A, 11B, 11C:
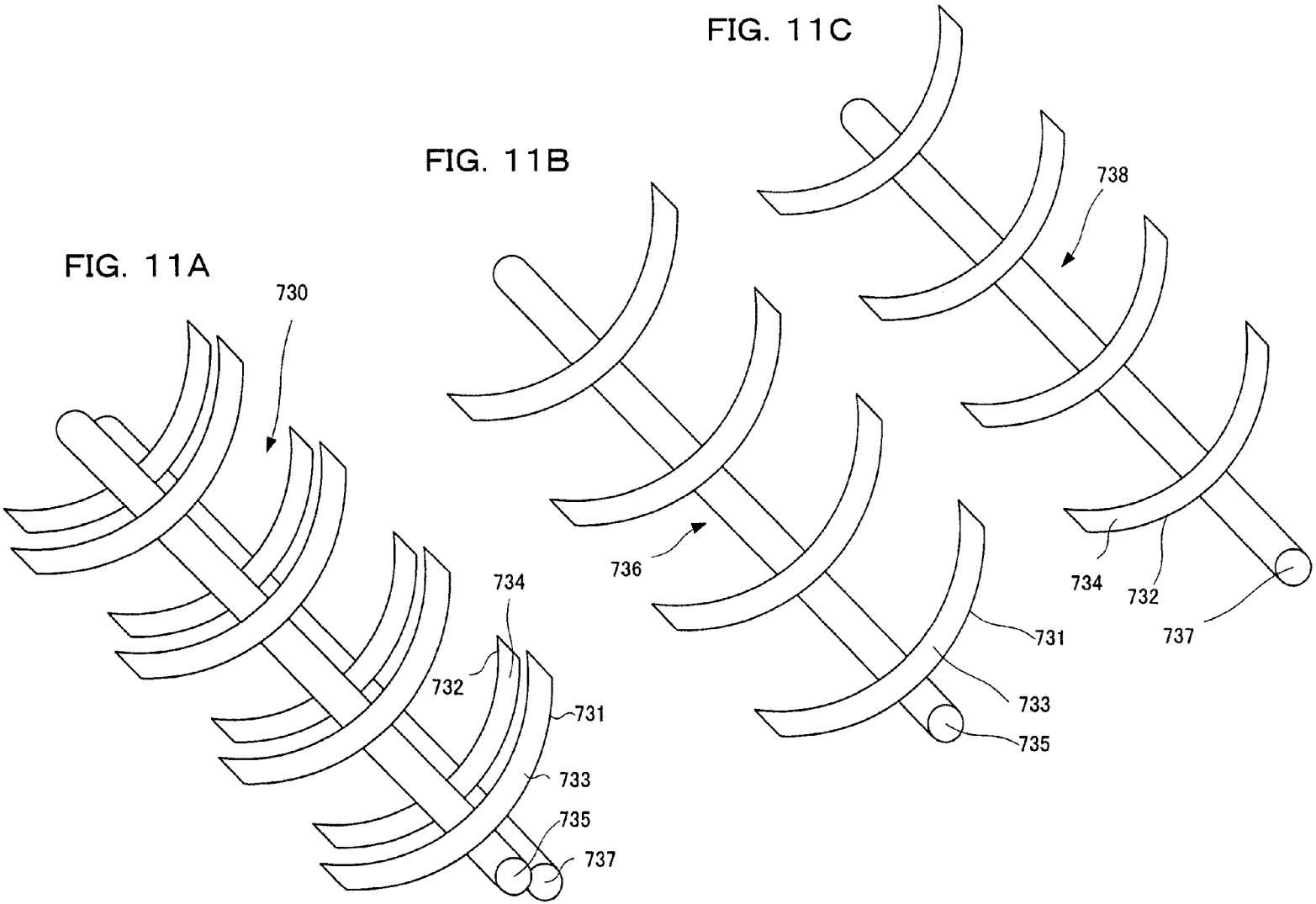
FIGS. 11A to 11C are perspective views showing the configuration of the turn guide.

Thus regarding the configuration of FIG. 8, a correlation between a curvature radius of the inversion/transfer surface 77*a* enabling smooth inversion of the sheet P and a thickness of the sheet and a correlation between a curvature radius of the inversion/transfer surface 77*a* and a length of the sheet in the paper transport direction were empirically determined as shown in the correlation diagram of FIG. 9. According to the results, the inversion/transfer surfaces 77*a* of the guide rib 77 have a curvature radius at least 100 times as large as the thickness of the sheet and less than 0.29 times as large as the length of the sheet in the paper transport direction.

Figure 3:
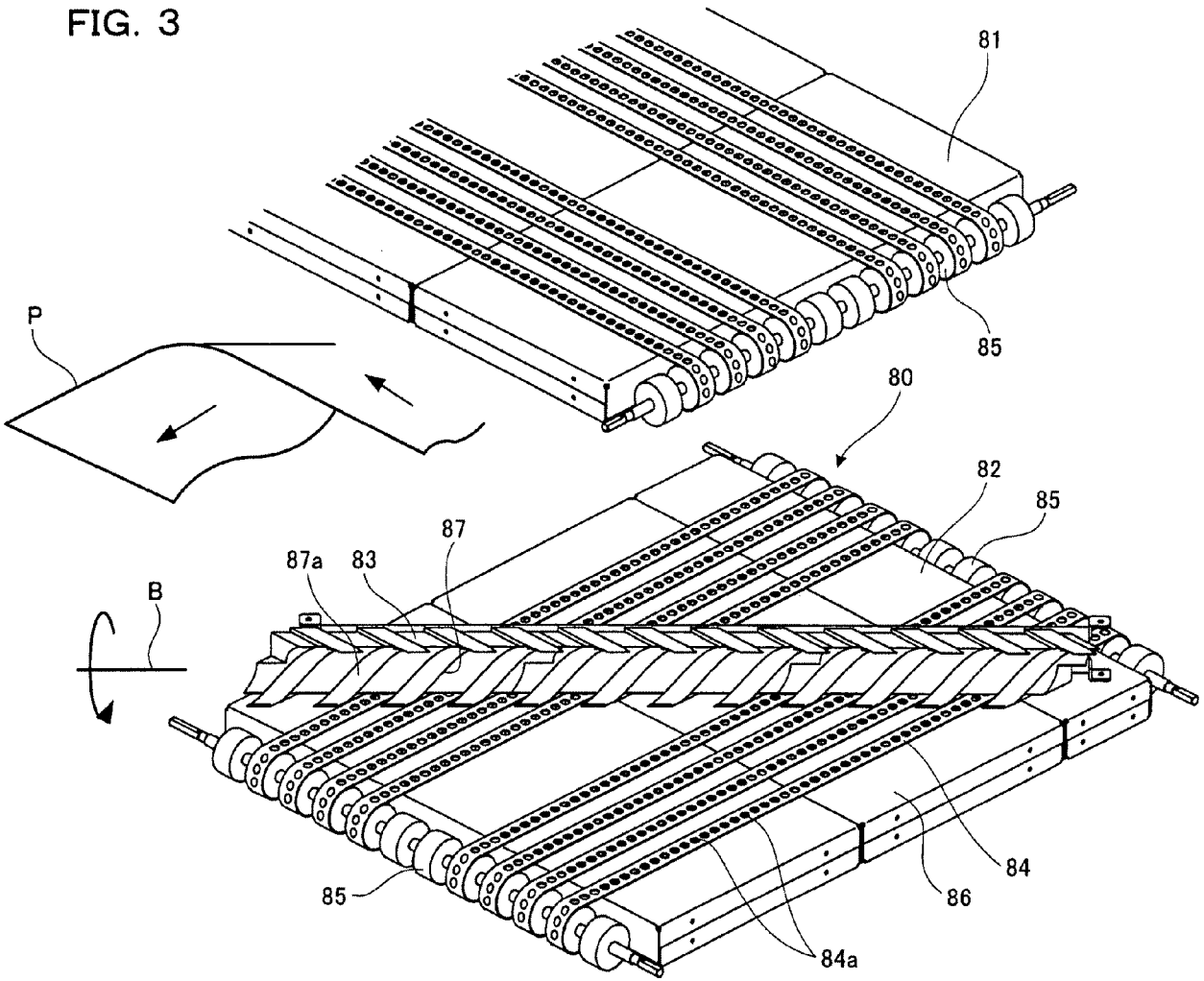
FIG. 3 is a perspective view showing a second paper transport apparatus according to the embodiment.

As shown in FIG. 3, the second paper transport apparatus 80 includes a first transport apparatus 81 forming a first transport surface (face down) on which a sheet of paper is transported in the horizontal direction, a second transport apparatus 82 forming a second transport surface (face up) which is opposed to the first transport surface and has a sheet transported in the horizontal direction, and a turn guide 83 which inverts the sheet P around an inversion axis B at a predetermined inversion angle, in this case, at 180° when the sheet P is transported from the first transport surface to the second transport surface, and changes the transport direction of the sheet at a predetermined turning angle, in this case, at 90°.

The upper first transport apparatus 81 and the lower second transport apparatus 82 are disposed at relative positions where the paper transport directions are orthogonal to each other. At the relative positions, the inversion axis B of the sheet P is tilted at 45° relative to a direction orthogonal to the paper transport directions. The turn guide 83 is in parallel with the inversion axis B.

The first transport apparatus 81 and the second transport apparatus 82 include a plurality of transport belts 84 moving on transport paths along the paper transport directions. The transport belts 84 are each made up of an endless belt looped over belt rollers 85 disposed on both ends of the transport paths.

The transport path is formed on a suction box 86 acting as a suction device. The suction box 86 communicates with an air suction source (not shown). As shown in FIG. 23, the suction box 86 has a plurality of openings 86*a* under the transport path. As shown in FIG. 19, the sheet P is sucked on the transport belts 84 through suction holes 84*a* formed on the transport belts 84.

The turn guide 83 has a plurality of guide ribs 87 which are arranged with a predetermined pitch along the inversion axis B; have a center distance of 20 mm to 50 mm in a direction orthogonal to the paper transport direction, and are interposed between the transport belts 84. The guide ribs 87 which are in slidable contact with the sheet P have slidable contract portions forming curved inverting transfer (i.e., inversion/transfer) surfaces 87*a* around the inversion axis B from an inversion start point corresponding to the first transport surface to an inversion end point corresponding to the second transport surface. On the inversion start point, the inversion/transfer surfaces 87*a* are directed to the paper transport direction of the first transport apparatus 81. On the inversion end point, the inversion/transfer surfaces 87*a* are directed to the paper transport direction of the second transport apparatus 82. Thus the inversion/transfer surfaces 87*a* are twisted at 90° between the inversion start point and the inversion end point. The inversion/transfer surfaces 87*a* have a curvature radius at least 100 times as large as the thickness of the sheet and less than 0.29 times as large as the length of the sheet in the transport direction (see FIGS. 4 and 5).

The third paper transport apparatus 90 is configured as in the first paper transport apparatus 70. One end of the third paper transport apparatus 90 is connected to the second transport apparatus 82 of the second paper transport apparatus 80 of the upper inverting transfer unit 6 and the other end of the third paper transport apparatus 90 is connected to the first transport apparatus 71 of the first paper transport apparatus 70 of the lower inverting transfer unit 6.

In the present embodiment, the third paper transport apparatus 90 includes a first transport apparatus 91 forming a first transport surface on which a sheet is transported in the vertical direction, a second transport apparatus 92 forming a second transport surface on which a sheet is transported in the horizontal direction, a third transport apparatus 93 forming a third transport surface on which a sheet is transported in the vertical direction, and a turn guide 94 which inverts a sheet of paper around an inversion axis at a predetermined inversion angle, in this case, at 90°. The first transport apparatus 91 is connected to the upper inverting transfer unit 6 and the third transport apparatus 93 is connected to the lower inverting transfer unit 6.

The first transport apparatus 91, the second transport apparatus 92, and the third transport apparatus 93 include a plurality of transport belts 95 moving on transport paths along the paper transport directions. The transport belts 95 are each made up of an endless belt looped over belt rollers 96 disposed on both ends of the transport paths.

The transport path is formed on a suction box 97 acting as a suction device. The suction box 97 communicates with an air suction source (not shown). As shown in FIG. 23, the suction box 97 has a plurality of openings 97*a* under the transport path. As shown in FIG. 19, the sheet P is sucked on the transport belts through suction holes 95*a* formed on the transport belts 95.

The turn guide 94 is identical to the turn guide 73 of the first paper transport apparatus 70 and thus the explanation thereof is omitted.

Figure 21A:
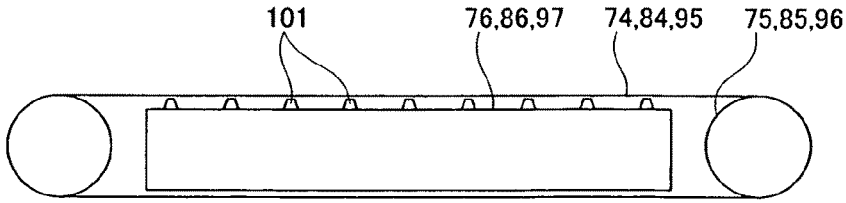
FIGS. 21A to 21D are schematic views showing the detail of each transport apparatus according to the embodiment of the present invention.
Figure 21B:
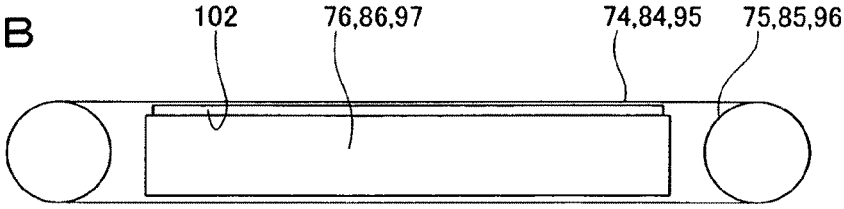
Figure 21C:
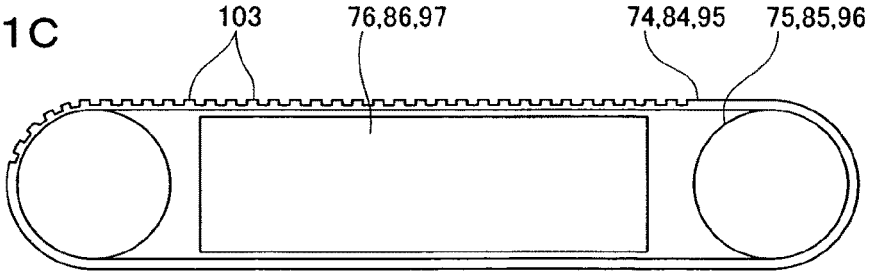
Figure 21D:
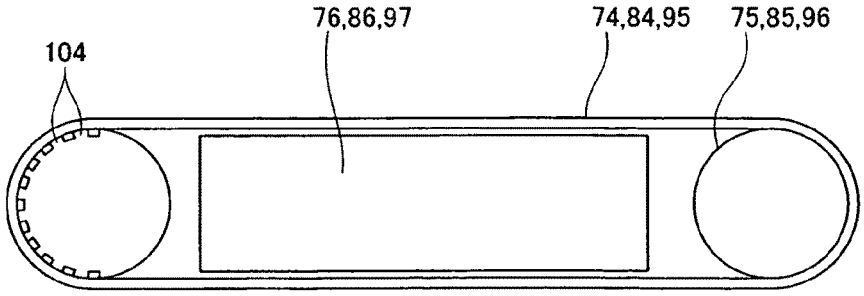
Figure 22A:
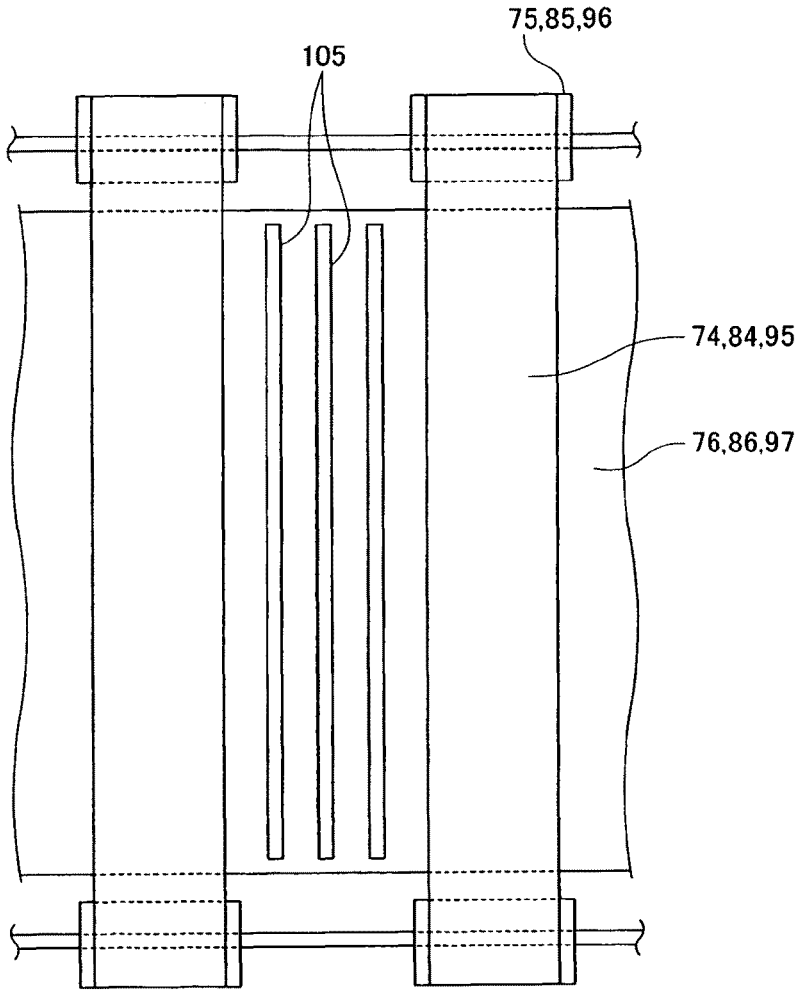
FIGS. 22A and 22B are schematic views showing the detail of each transport apparatus according to the embodiment of the present invention.
Figure 22B:
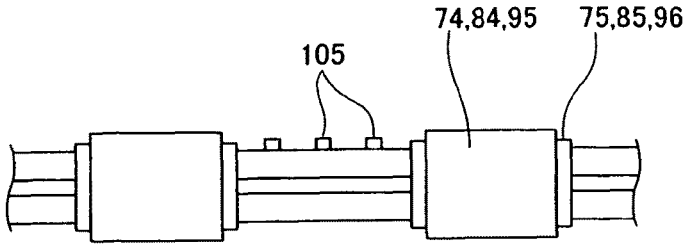

As shown in FIG. 21A, the transport apparatuses 71, 72, 81, 82, 91, 92 and 93 may include a plurality of protrusions 101 formed as low-friction members on portions where the transport belts 74, 84 and 95 slide. Alternatively, a low-friction member 102 may be provided as shown in FIG. 21B. As shown in FIG. 21C, the transport belts 74, 84 and 95 have a plurality of protrusions 103 formed on the surfaces coming into contact with a sheet of paper. As shown in FIG. 21D, the belt rollers 75, 85 and 96 for driving the transport belts 74, 84 and 95 have a plurality of protrusions 104 formed on portions pressed to the transport belts. As shown in FIGS. 22A and 22B, the transport apparatuses 71, 72, 81, 82, 91, 92 and 93 include a plurality of ribs 105 acting as paper support members between the transport belts 74, 84 and 95.

The ribs 105 are as high as or lower than the surfaces of the transport belts on the transport path. On a position corresponding to the inversion start point of the turn guide, the ribs 105 are higher than the inverting transfer surfaces. On a position corresponding to the inversion end point of the turn guide, the ribs 105 are lower than the inversion/transfer surfaces. On the top surfaces of the ribs coming into contact with a sheet of paper, corners disposed along the paper transport direction are preferably curved to prevent a scratch on the sheet.

The operation of the aforementioned configuration will be described below. The sheet P having one side printed by the printer body 3 enters the upper inverting transfer unit 6 of the paper inverting mechanism 4 and reaches the start end of the first transport apparatus 71 of the first paper transport apparatus 70. As shown in FIG. 19, the first transport apparatus 71 sucks, on the transport belts, the opposite side of the sheet P from the printed surface through the suction holes 74*a* formed on the transport belts 74, by means of the suction box 76. In this state, as shown in FIG. 2, the transport belts 74 move on the transport path with the sheet, so that the sheet P is transported in the paper transport direction on the first transport surface.

When the sheet P is ejected to the paper receiving unit 7 through the paper inverting mechanism 4 in the shortest time, as shown in FIG. 6, the guide ribs 77 of the turn guide 73 are operated so as to separate the first transport surface and the second transport surface, and the sheet P is ejected from the first transport apparatus 71 to the paper receiving unit 7.

After printed in the printer body 3, when the sheet P has to be kept in the paper inverting mechanism 4 for a longer time to dry the printed surface of the sheet, as shown in FIG. 7, the guide ribs 77 of the turn guide 73 are operated so as to connect the first transport surface and the second transport surface.

This configuration can be provided at some point of the third transport apparatus 93 to switch, when a mechanism is provided to return the sheet to the printer body 3, a state in which the sheet is introduced into the mechanism and a state in which the sheet is not introduced into the mechanism.

As shown in FIG. 2, the first transport apparatus 71 transports the sheet P in the paper transport direction on the first transport surface, the sheet P reaches the turn guide 73, and then the end of the sheet enters the inversion/transfer surfaces 77*a* from the inversion start point of the turn guide 73. In this case, as the sheet P moves in the paper transport direction, the guide ribs 77 guide the end of the sheet with the inversion/transfer surfaces 77*a*, the back side of the sheet P comes into slidable contact with the inversion/transfer surfaces 77*a*, and the surfaces of the sheet P are inverted and curved, following the end of the sheet, according to the inversion/transfer surfaces 77*a*. In this case, the sheet P is inverted at 90°.

At this point, the inversion/transfer surfaces 77*a* of the guide ribs 77 have a curvature radius at least 100 times as large as the thickness of the sheet and less than 0.29 times as large as the length of the sheet in the transport direction. Thus the sheet P can be smoothly inverted.

When the sheet P reaches the second transport apparatus 72 and one end of the sheet enters the second transport surface from the inversion end point of the inversion/transfer surfaces 77*a* of the guide ribs 77 of the turn guide 73, the second transport apparatus 72 sucks, on the transport belts, the opposite side of the sheet P from the printed surface through the suction holes 74*a* formed on the transport belts 74, by means of the suction box 76. The transport belts 74 move on the transport path with the sheet P, so that the sheet P is transported in the paper transport direction on the second transport surface. In this case, the first transport apparatus 71 transports the sheet P until the rear end of the sheet reaches the inversion start point of the turn guide 73.

When the sheet P reaches the terminal end of the second transport apparatus 72, one end of the sheet enters a turn guide (identical to the turn guide 73 and not shown in FIG. 2), is inverted at 90° as in the foregoing operation, and enters the second paper transport apparatus 80.

As shown in FIG. 3, in the second paper transport apparatus 80, the first transport apparatus 81 sucks, on the transport belts, the opposite side of the sheet P from the printed surface through the suction holes 84*a* formed on the transport belts 84, by means of the suction box 86. The transport belts 84 move on the transport path with the sheet P, so that the sheet P is transported in the paper transport direction on the first transport surface.

When the sheet P reaches the turn guide 83 and one end of the sheet P enters the inversion/transfer surfaces 87*a* from the inversion start point of the turn guide 83, the guide ribs 87 guide the end of the sheet with the inversion/transfer surfaces 87*a* as the sheet P moves in the paper transport direction, the back side of the sheet P comes into slidable contact with the inversion/transfer surfaces 87*a*, and the surfaces of the sheet P are inverted and curved, following the end of the sheet, according to the inversion/transfer surfaces 87*a*. In this case, the sheet is inverted at 180°.

At this point, the inversion/transfer surfaces 87*a* of the guide ribs 87 have a curvature radius at least 100 times as large as the thickness of the sheet and less than 0.29 times as large as the length of the sheet in the transport direction. Thus the sheet P can be smoothly inverted.

The upper first transport apparatus 81 and the lower second transport apparatus 82 are disposed at relative positions where the paper transport directions are orthogonal to each other. The turn guide is disposed such that the inversion axis B of the sheet P is tilted at the relative positions at 45° relative to a direction orthogonal to the paper transport direction.

Therefore, one corner of the end of the sheet P first reaches the turn guide 83 and then the end of the sheet enters the inversion/transfer surfaces 87*a* from the corner of the end. The entry of the end of the sheet P to the inversion/transfer surfaces 87*a* is delayed as being close to the other corner of the end of the sheet P. The sheet P is first inverted from the corner having first entered the inversion/transfer surfaces 87*a* and the start of the inversion is delayed as being close to the other corner of the end of the sheet P, so that the transport direction of the sheet P is changed.

In other words, when the sheet P is transferred from the first transport surface to the second transport surface, the turn guide 83 inverts the sheet P at the predetermined inversion angle around the inversion axis tilted at a predetermined angle of 45° relative to a direction orthogonal to the paper transport direction of the first transport apparatus 81, so that the transport direction of the sheet P is changed at a predetermined turning angle of 90°.

Figure 4:
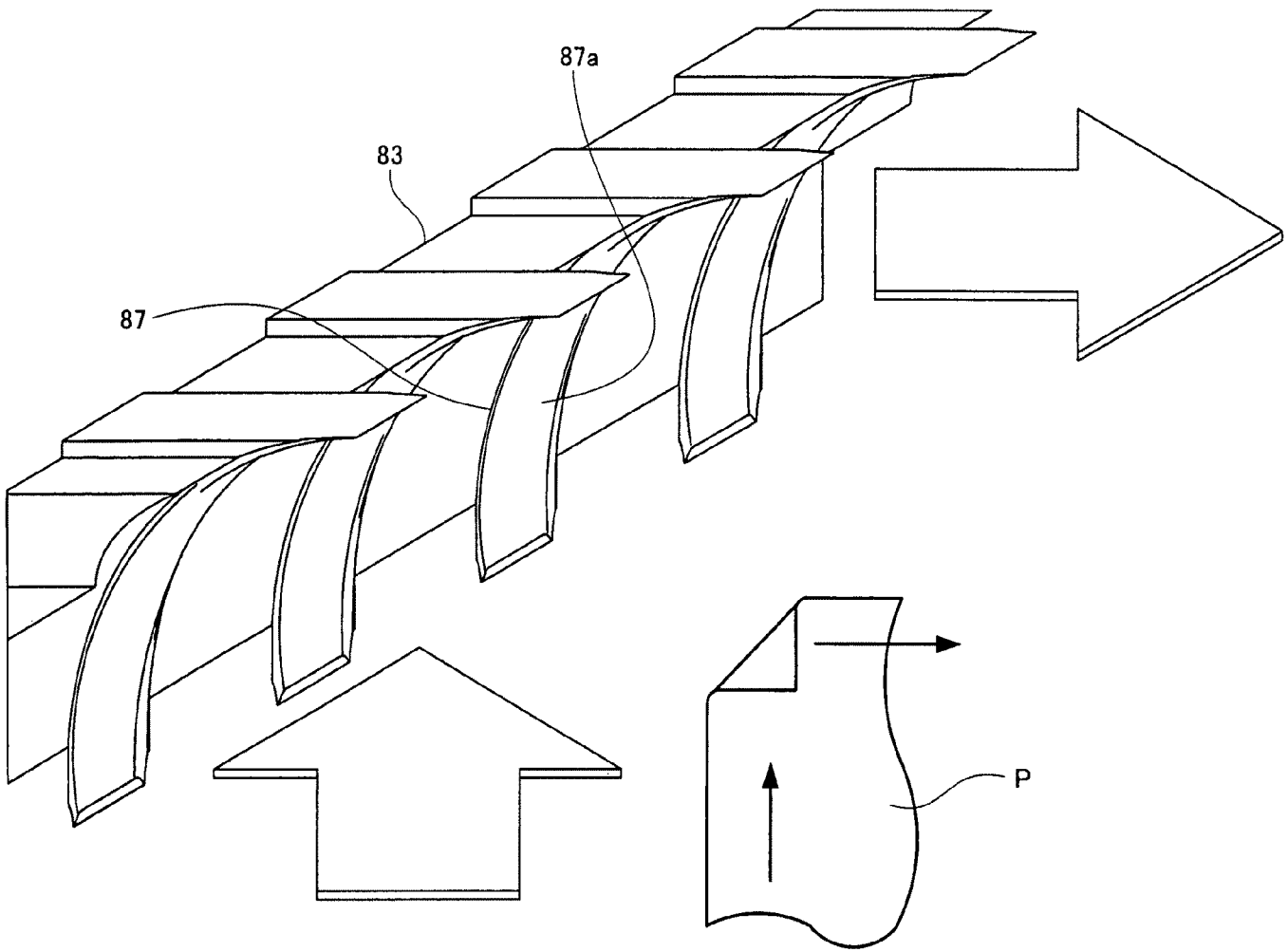
FIG. 4 is a perspective view showing a turn guide of the second paper transport apparatus according to the embodiment.
Figure 5:
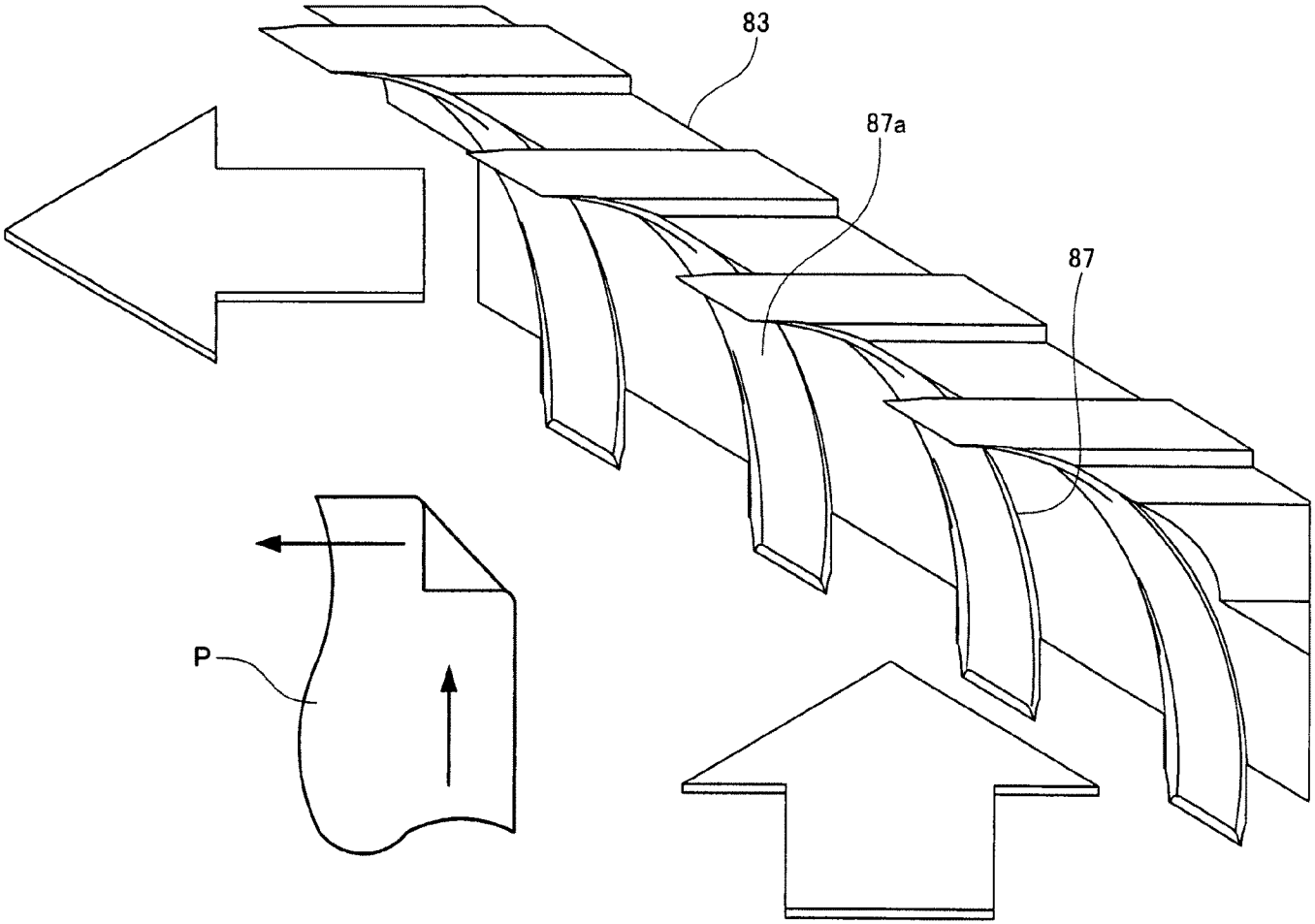
FIG. 5 is a perspective view showing another turn guide of the second paper transport apparatus according to the embodiment.

FIG. 4 shows the shape of the turn guide 83 when the paper transport direction is changed to the right at 90° and is inverted at 180°. FIG. 5 shows the shape of the turn guide 83 when the paper transport direction is changed to the left at 90° and is inverted at 180°.

When the sheet P reaches the second transport apparatus 82 and the end of the sheet enters the second transport surface from one corner of the end, the second transport apparatus 82 transports the sheet P in the paper transport direction on the second transport surface. At this point, on the second transport surface, the sheet P returns to a position where the end is in parallel with a direction orthogonal to the paper transport direction.

When the sheet P reaches the terminal end of the second transport apparatus 82, one end of the sheet enters a turn guide (identical to the turn guide 73 and not shown in FIG. 3), is inverted at 90° as in the foregoing operation, and enters the third paper transport apparatus 90.

The third paper transport apparatus 90 repeatedly inverts the sheets P at 90° while transporting the sheets P by the same operation as the first paper transport apparatus 70, and feeds the sheets P to the first transport apparatus 71 of the first paper transport apparatus 70 of the lower inverting transfer unit 6.

As described above, the sheet P is inverted and the transport direction is changed in the upper inverting transfer unit 6 of the paper inverting mechanism 4, the sheet P is transferred to the lower inverting transfer unit 6, and then the sheet P is inverted and the transport direction is changed in the lower inverting transfer unit 6 as in the upper inverting transfer unit 6. After that, the sheet P is ejected to the paper receiving unit 7.

When paper powder from the transported sheet P falls between the transport belts 74, 84 and 95 and the sheet P sucked on the transport belts, the sheet P may slide. By collecting paper powder between the plurality of protrusions 103 provided on the transport belts 74, 84 and 95, it is possible to prevent the paper powder from falling between the transport belts 74, 84 and 95 and the sheet P, so that the sheet can be reliably transported. Further, by engaging the rear end of the sheet onto the protrusions 103 of the transport belts 74, 84 and 95, the sheet P can be reliably pressed and transported.

When paper powder falls between the transport belts 74, 84 and 95 and the belt rollers 75, 85 and 96, the transport belts 74, 84 and 95 may slide. By collecting paper powder between the plurality of protrusions 104 provided on the belt rollers 75, 85 and 96, it is possible to prevent the paper powder from falling between the belt rollers 75, 85 and 96 and the transport belts 74, 84 and 95, so that the transport belts 74, 84 and 95 can be reliably driven.

It is preferable that the protrusions 103 provided on the transport belts 74, 84 and 95 are 0.5 mm or less in height. When the heights of the protrusions exceed 0.5 mm, air leaks from between the protrusions 103 and the suction force is reduced, so that the sheet P may not be sufficiently sucked.

Figure 20:
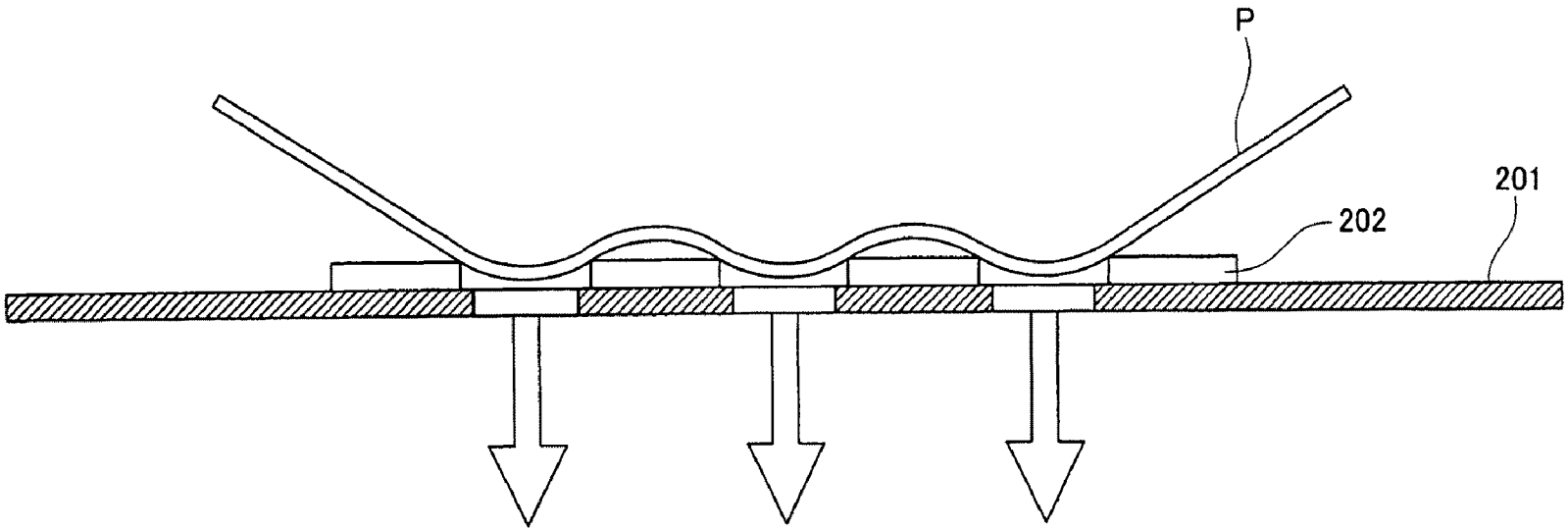
FIG. 20 PRIOR ART
FIG. 20 is a sectional view showing a transport state of a transport apparatus according to the prior art.

As shown in FIG. 20, in a configuration where a suction box 201 sucks the sheet P between transport belts 202, the sheet P enters between the transport belts 202 and dents are formed on the sheet P. On the reverse side of the sheet P, protrusions are formed between the transport belts 202 and the sheet P is wrinkled.

However, in the present embodiment, as shown in FIG. 19, the first transport apparatuses 71, 81 and 91 and the second transport apparatuses 72, 82 and 92 of the first to third paper transport apparatuses 70, 80 and 90 and the third transport apparatus 93 of the third paper transport apparatus 90 suck, on the transport belts, the opposite side of the sheet P from the printed surface through the suction holes 74*a*, 84*a* and 95*a* formed on the transport belts 74, 84 and 95, by means of the suction boxes 76, 86 and 97. The transport belts 74, 84 and 95 move on the transport path with the sheet P, so that the sheet P is transported in the paper transport direction on the first transport surface. Thus it is possible to prevent a deformation of the sheet P. Further, the sheet P is supported by the ribs 105 between the transport belts to prevent a deformation of the sheet P, thereby preventing wrinkles when the sheet P is inverted.

Moreover, the diameters of the suction holes 74*a*, 84*a* and 95*a* of the transport belts 74, 84 and 95 are estimated at least 5 mm to obtain a suction force allowing the transport belts 74, 84 and 95 to securely hold the sheet P in the suction holes 74*a*, 84*a* and 95*a*. When the suction holes 74*a*, 84*a* and 95*a* are formed at the centers of the transport belts 74, 84 and 95, it is preferable to leave at least a 5 mm width on each side of the suction holes 74*a*, 84*a* and 95*a* in consideration of the strengths of the belts. As a result, the belts have to be at least 15 mm in width. Moreover, the guide ribs have to be at least 2 mm in width in order to sufficiently hold the underside of the sheet.

As described above, it is most preferable that the guide ribs have a center distance of at least 20 mm in a direction orthogonal to the paper transport direction, in consideration of gaps between the guide ribs and the transport belts. When spacing between the guide ribs is too large, the end of the sheet is likely to be inserted between the guide ribs. Thus it is preferable to suppress the center distance between the guide ribs to 50 mm or less according to test results.

The foregoing embodiment described the fixed turn guides. The turn guides 73, 83 and 94 may be movable. The following will describe an example of a turn guide applied to the first paper transport apparatus 70. The turn guide can be similarly configured in the second paper transport apparatus 80 and the third paper transport apparatus 90.

As shown in FIGS. 10 and 11A to 11C, a turn guide 730 has a plurality of guide ribs 731 and 732 arranged along the inversion axis of a sheet of paper. The guide ribs 731 and 732 have curved inverting transfer (i.e., inversion/transfer) surfaces 733 and 734 around the inversion axis, from an inversion start point corresponding to a first transport surface to an inversion end point corresponding to a second transport surface.

In this configuration, the two kinds of guide ribs 731 and 732 are alternately disposed with the inversion/transfer surfaces 733 and 734 having different curvature radii. More than two kinds of guide ribs may be alternately disposed. The curvature radii of the inversion/transfer surfaces 733 and 734 are at least 100 times as large as the thickness of the sheet and less than 0.29 times as large as the length of the sheet in the transport direction. The curvature radii of both the inversion/transfer surface 733 of the guide rib 731 and the inversion/transfer surface 734 of the guide rib 732 vary with the size and thickness of the sheet.

The plurality of guide ribs 731 having the same curvature radius are connected via a connecting member 735 to form a guide rib group 736 and the plurality of guide ribs 732 having the same curvature radius are connected via a connecting member 737 to form a guide rib group 738. The guide rib groups 736 and 738 can move between an operation position where the guide rib groups are connected to the first transport surface of the first transport apparatus 71 and the second transport surface of the second transport apparatus 72 so as to guide the sheet P and a retraction position where the guide rib groups are separated from the first transport surface of the first transport apparatus 71 and the second transport surface of the second transport apparatus 72 so as not to guide the sheet. The guide rib groups 736 and 738 are connected to a moving mechanism such as a motor.

With this configuration, when the sheet P transported by the first transport apparatus 71 is not inverted to the second transport apparatus 72, the guide rib groups 736 and 738 are disposed on the retraction position. When the sheet P transported by the first transport apparatus 71 is inverted to the second transport apparatus 72, one of the guide rib groups 736 and 738 is disposed on the operation position and the other is disposed on the retraction position. The guide rib group disposed on the operation position has a curvature radius suitable for the thickness and size of the transported sheet P. Thus the sheet P can be smoothly inverted.

Figure 12:
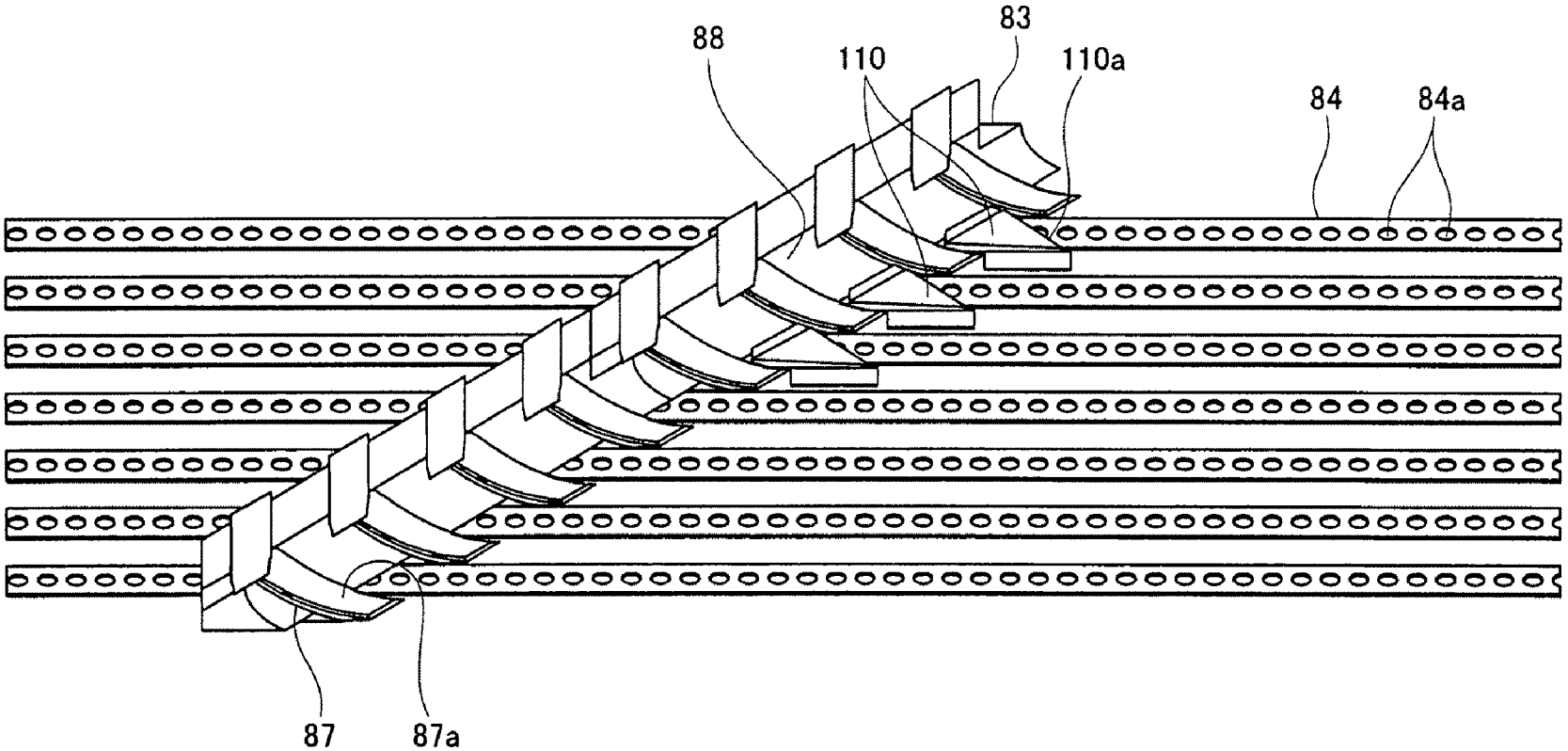
FIG. 12 is a perspective view showing a turn guide of a second paper transport apparatus according to another embodiment of the present invention.
Figure 13:
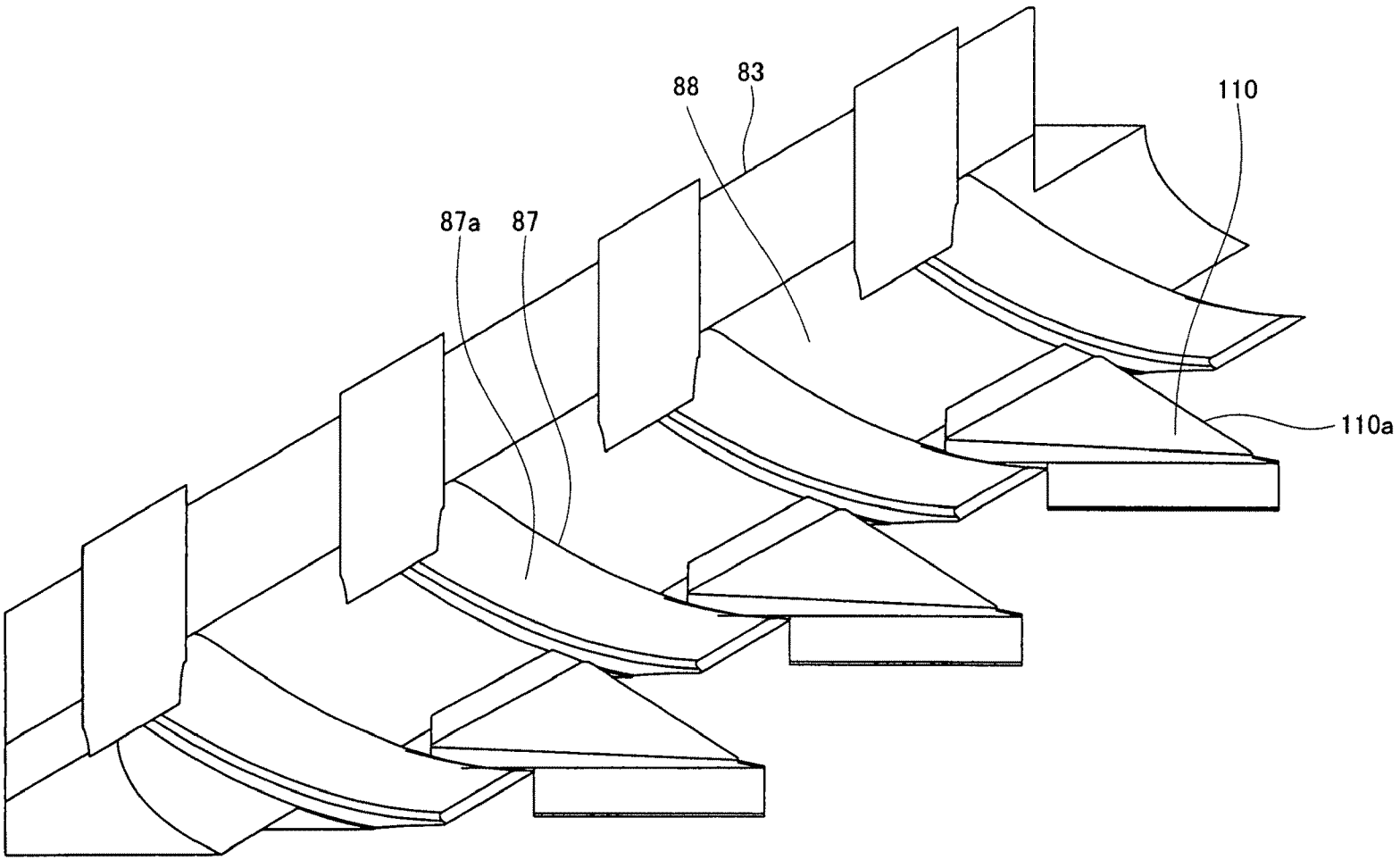
FIG. 13 is an enlarged perspective view showing the turn guide.
Figure 14:
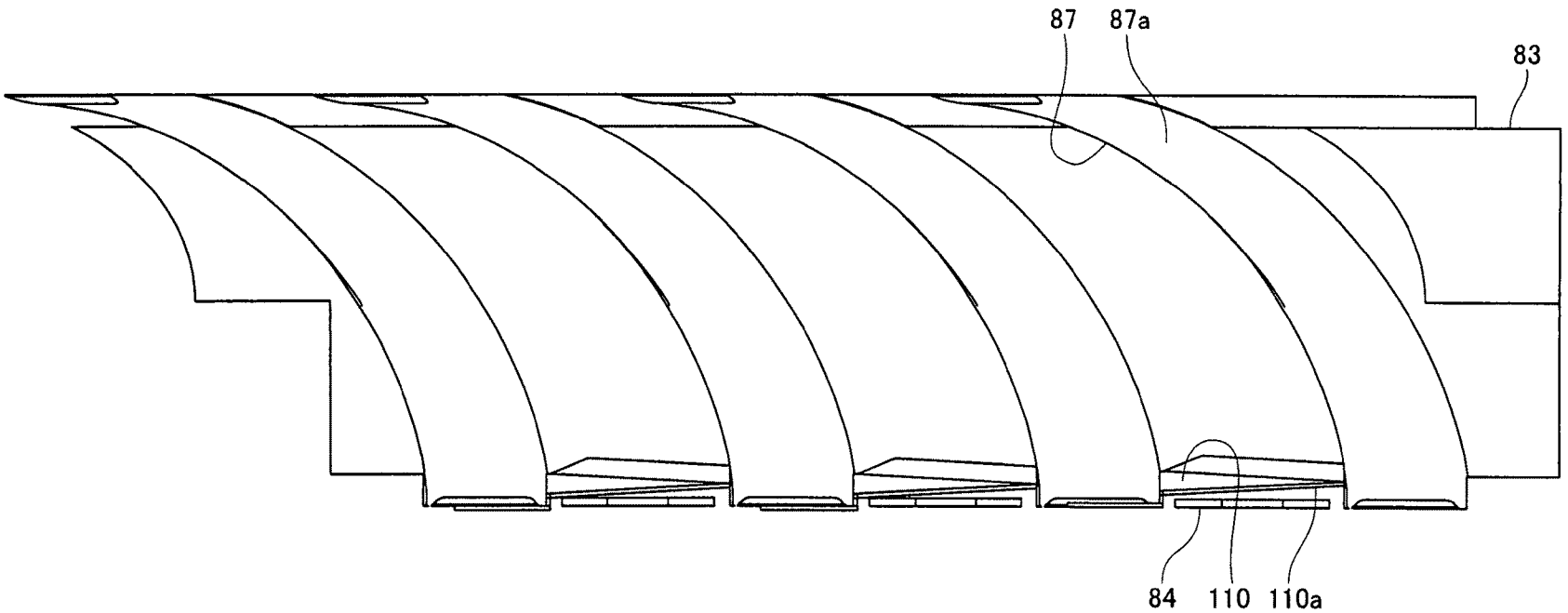
FIG. 14 is a front view showing the turn guide.

FIGS. 12 to 14 show another embodiment of the present invention. This embodiment is based on the configuration of the second paper transport apparatus 80 previously shown in FIG. 3. To be specific, an upper first transport apparatus 81 and a lower second transport apparatus 82 are disposed at relative positions where the paper transport directions are orthogonal to each other. A turn guide 83 is disposed such that an inversion axis B of a sheet P is tilted at the relative positions at 45° relative to a direction orthogonal to the paper transport directions.

Therefore, a corner on one side of the sheet P first reaches the turn guide 83 and then one end of the sheet enters inversion/transfer surfaces 87*a* from the corner. The entry of the end of the sheet P to the inversion/transfer surfaces 87*a* is delayed as being close to a corner on the other side of the sheet P. The sheet P is first inverted from the corner having first entered the inversion/transfer surfaces 87*a* and the start of the inversion is delayed as being close to the corner on the other side of the sheet P, so that the transport direction of the sheet P is changed.

The turn guide 83 has a plurality of escape portions 110 at an inversion start point corresponding to a first transport surface and between guide ribs corresponding to the corner of the sheet. The escape portions 110 are disposed on positions first coming into contact with the sheets P of various sizes in the paper transport direction.

The escape portions 110 are extended from a guide rib 87 disposed inside the corner of the sheet to the guide rib 87 disposed outside the corner of the sheet, and escape portion front ends 110*a* which come into slidable contact with the end of the sheet are formed so as to gradually retreat in the paper transport direction as being close to the guide rib 87 disposed outside the corner of the sheet. The escape portion front ends 110*a* have an elevation angle tilted at a predetermined angle relative to the first transport surface of the first transport apparatus 81. Further, the escape portion front ends 110*a* are tilted to a predetermined angle relative to a direction orthogonal to the transport direction in the first transport surface and are tilted at 30° to 60°.

In this configuration, the escape portions 110 have side edges which are in contact with the guide ribs 87 disposed inside the escape portions 110. The side edges are placed higher than the inversion/transfer surfaces 87*a* of the guide ribs 87 disposed inside the escape portions 110 and are formed along transport belts 84. Further, the escape portion front ends 110*a* are positioned on guide surfaces 88 which are formed between the guide ribs 87 by the rear ends of the escape portions having retreated in the paper transport direction. The escape portions 110 are preferably made up of flexible members separated from the turn guide 83.

With this configuration, when the sheet P is transferred from the first transport surface to a second transport surface, the sheet P is inverted at a predetermined inversion angle of 180° and the direction of the sheet P is changed at a predetermined turning angle of 90° by passing the sheet P through the turn guide 83.

As the sheet moves in the paper transport direction, the guide ribs 87 guide the end of the sheet with the inversion/transfer surfaces 87*a*, the sheet is first inverted from the corner on one end having first entered the inversion/transfer surfaces, and the surfaces of the sheet P are inverted and curved, following the end of the sheet, according to the inversion/transfer surfaces 87*a*.

Figure 16:
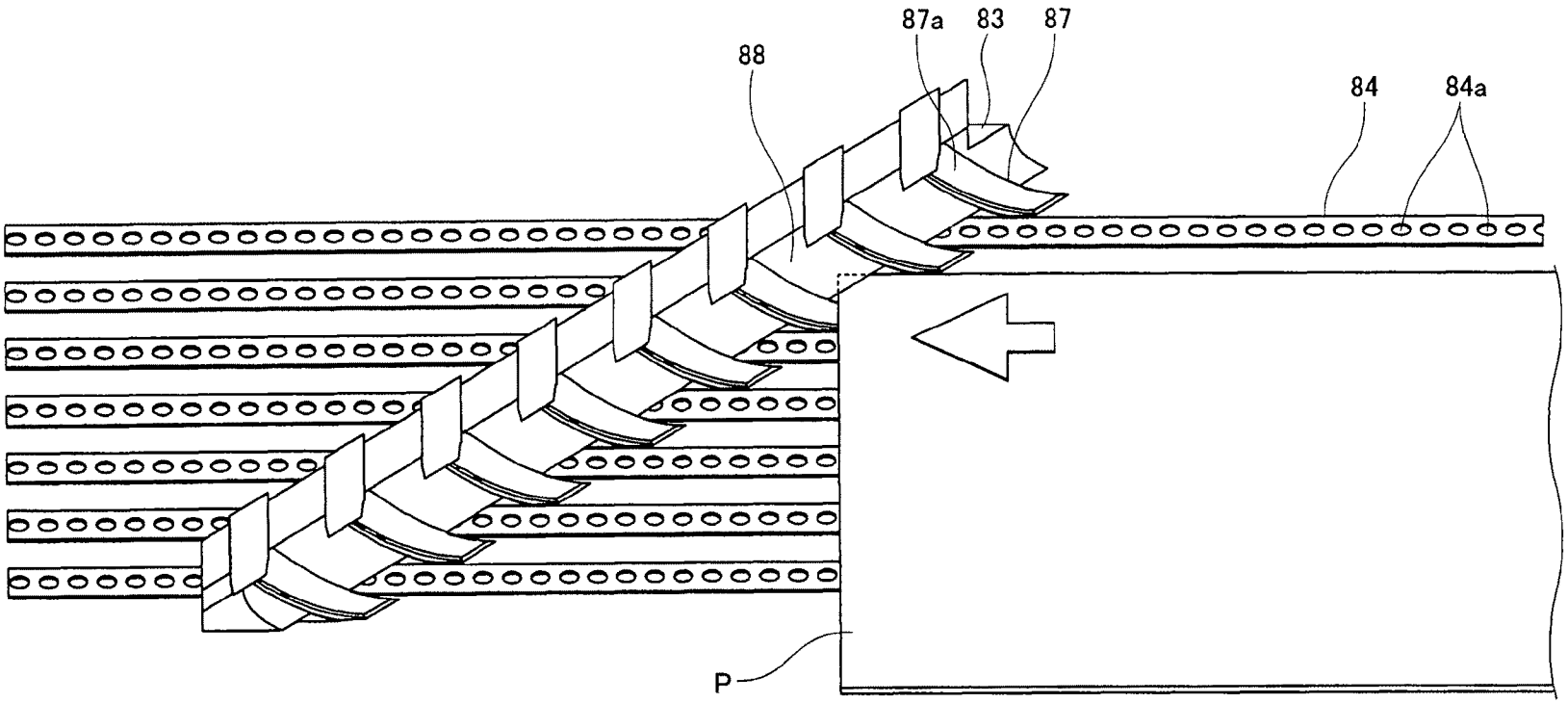
FIG. 16 is a schematic view showing a jam caused by a turn guide including no escape portions.

As shown in FIG. 16, when the escape portions 110 are not provided, the corner on one end of the sheet P enters between the guide ribs 87 while being bent lower than the inversion/transfer surfaces 87*a* by curling and the like of the sheet P. In this case, the corner comes under the guide surface 88 between the guide ribs 87 and is not inverted, thereby interfering with the inversion of an edge on one side of the sheet P, following the corner of the end. Thus a paper jam occurs.

Figure 15:
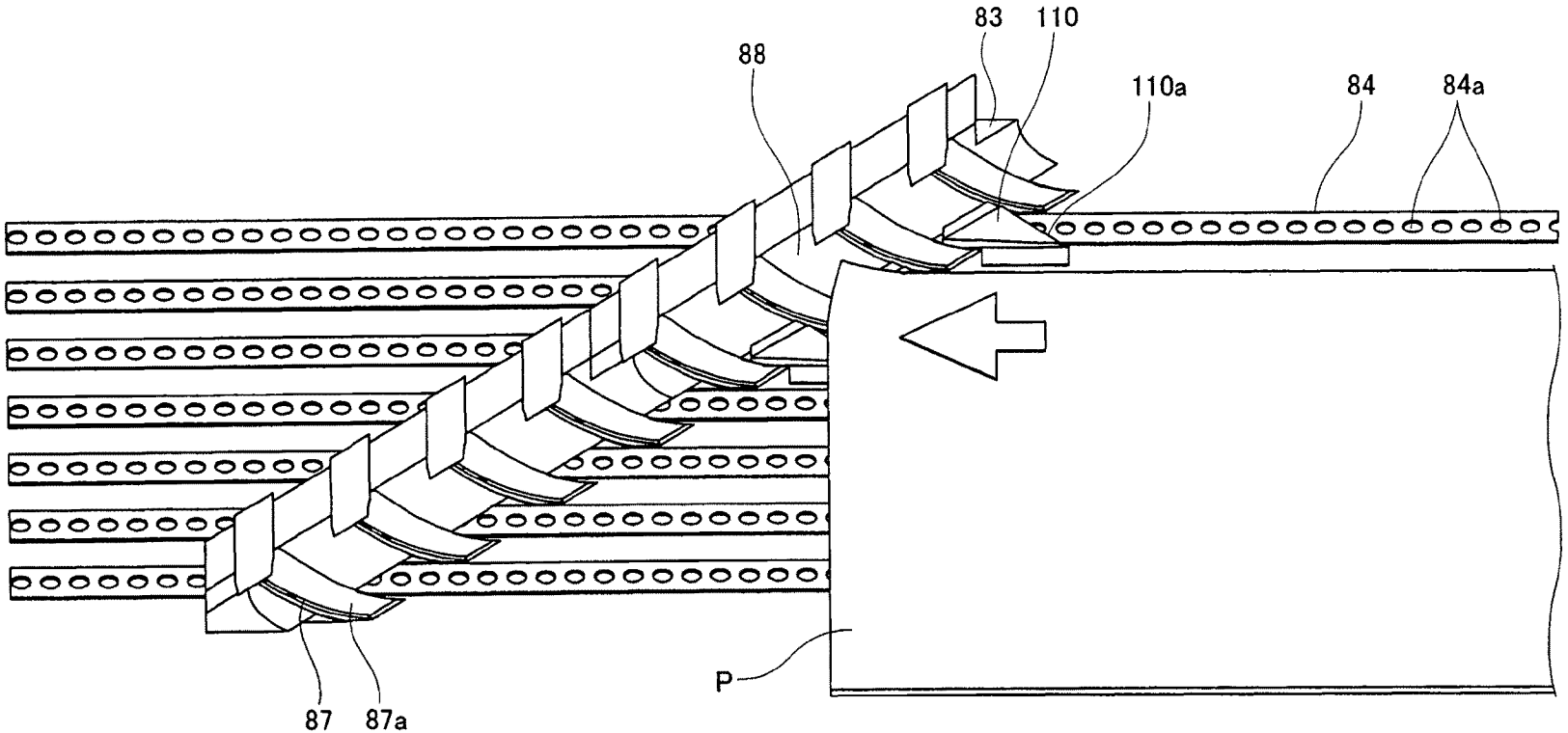
FIG. 15 is a schematic view showing a sheet of paper inverted by the turned guide.

However, as shown in FIG. 15, the escape portion front ends 110*a* of the escape portions 110 are provided between the guide ribs 87 corresponding to the corner on one end of the sheet P and the escape portion front ends 110*a* come into slidable contact with the end of the corner of the sheet P which is bent lower than the inversion/transfer surfaces 87*a*. The escape portion front ends 110*a* are formed so as to gradually retreat in the transport direction, so that as the sheet P moves in the paper transport direction, the escape portions 110 guide the end of the sheet upward with the escape portion front ends 110*a*, the position of the corner on one end of the sheet P is corrected, and the corner is smoothly inverted. Thus it is possible to prevent a paper jam.

Figure 17:
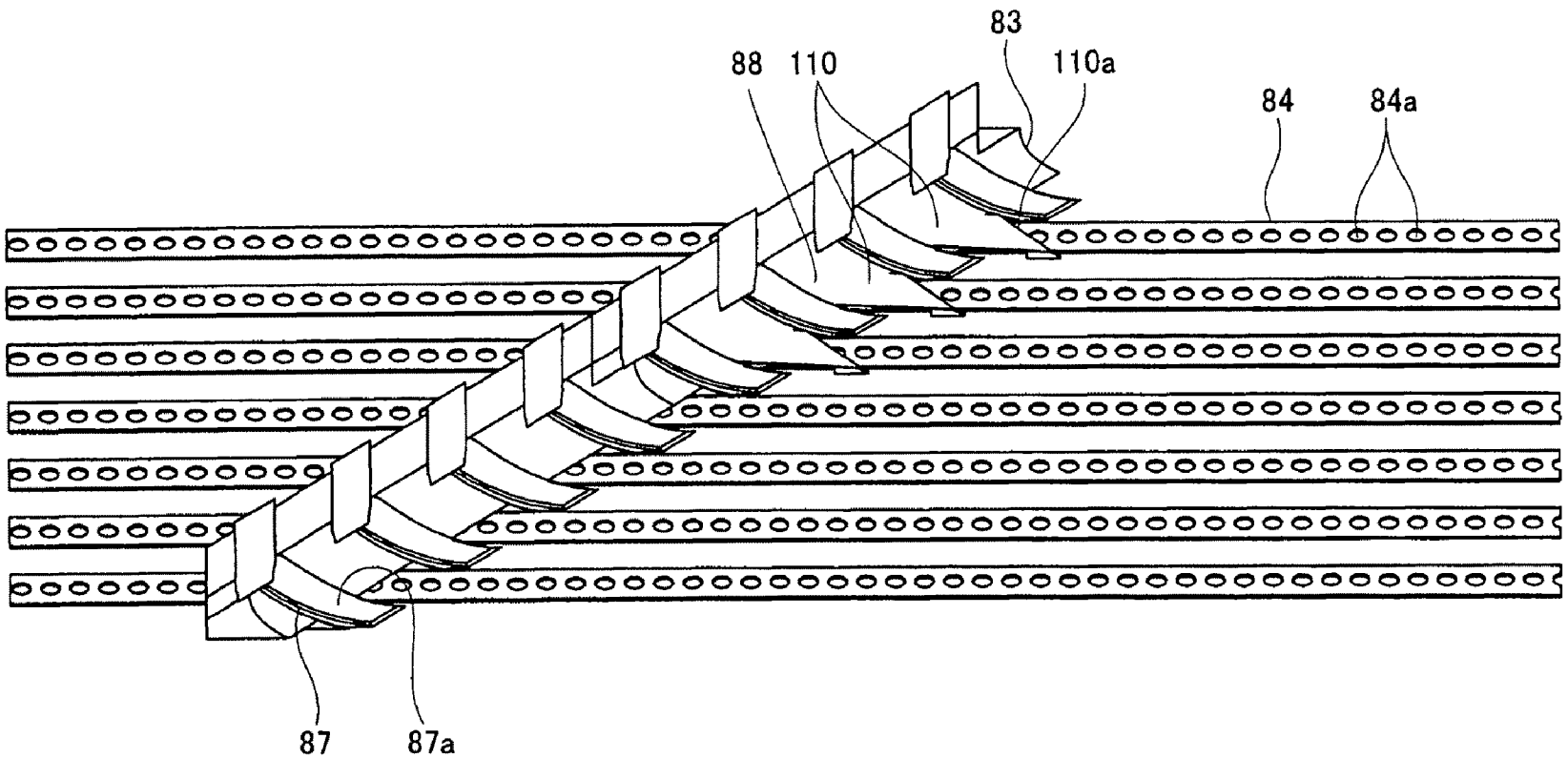
FIG. 17 is a perspective view showing the turn guide of the second paper transport apparatus according to another embodiment of the present invention.
Figure 18:
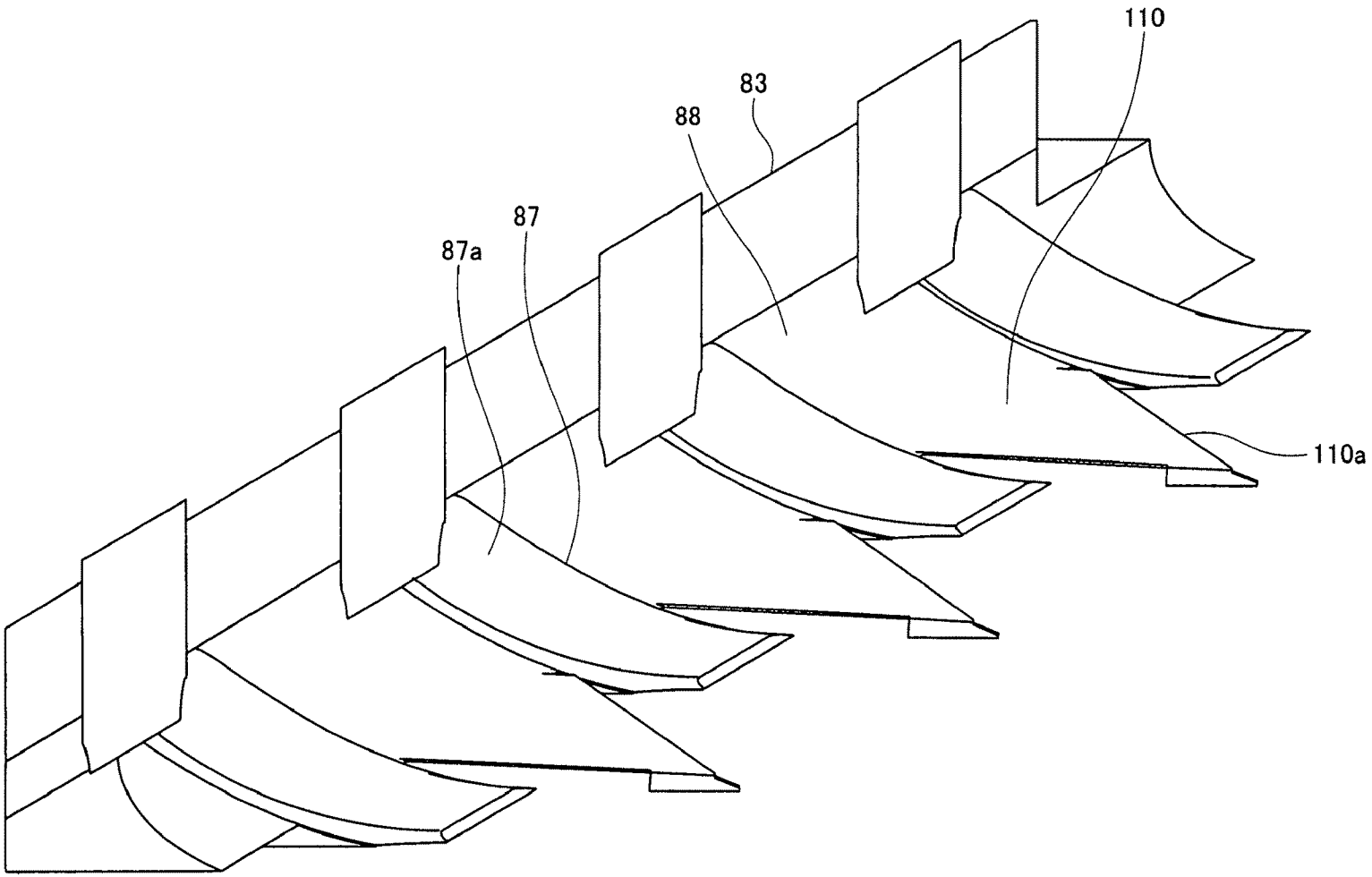
FIG. 18 is an enlarged perspective view showing the turn guide.

As shown in FIGS. 17 and 18, the escape portions 110 may be formed such that the side edges of the escape portions 110 coming into contact with the guide ribs 87 disposed inside the escape portions 110 are placed higher than the inversion/transfer surfaces 87*a* of the guide ribs 87 disposed inside the escape portions 110 and the escape portion front ends 110*a* have escape portion rear ends which have retreated in the paper transport direction and are placed higher than the inversion/transfer surfaces 87*a* of the guide ribs 87 disposed outside the escape portions 110.

What is claimed is:

1. A paper transport apparatus, comprising:

a first transport apparatus for transporting a sheet to be transported in a first paper transport direction, the first transport apparatus having a first transport surface on which the sheet is transported while being sucked, the sheet having a thickness of 0.05 mm to 0.35 mm and a length of 50 mm to 450 mm in the paper transport direction;

a second transport apparatus for transporting a sheet to be transported in a second paper transport direction, the second transport apparatus having a second transport surface on which the sheet is transported while being sucked, the sheet having a thickness of 0.05 mm to 0.35 mm and a length of 50 mm to 450 mm in the paper transport direction; and a turn guide provided between the first transport apparatus and the second transport apparatus to invert the sheet as the sheet is transferred from the first transport surface and over the turn guide to the second transport surface, wherein the turn guide has slidable contact portions coming into slidable contact with the sheet and forming inverting transfer surfaces, the inverting transfer surfaces are continuous and curved around an inversion axis of the sheet from an inversion start point corresponding to the first transport surface to an inversion end point corresponding to the second transport surface, the inverting transfer surfaces have a curvature radius at least 100 times as large as a thickness of the sheet and less than 0.29 times as large as a length of the sheet in a transport direction, said first and second paper transport directions are at 90°, and said inversion axis is tilted at 45° relative to a direction orthogonal to said paper transport direction.

* * * * *